US009186892B2

(12) United States Patent
Horiguchi et al.

(10) Patent No.: US 9,186,892 B2
(45) Date of Patent: Nov. 17, 2015

(54) LIQUID JET HEAD AND LIQUID JET APPARATUS

(71) Applicants: SII PRINTEK INC., Chiba-shi, Chiba (JP); SEIKO INSTRUMENTS INC., Chiba-shi, Chiba (JP)

(72) Inventors: Satoshi Horiguchi, Chiba (JP); Tokio Tatsumi, Chiba (JP)

(73) Assignees: SII PRINTEK INC. (JP); SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/639,229

(22) Filed: Mar. 5, 2015

(65) Prior Publication Data

US 2015/0258782 A1 Sep. 17, 2015

(30) Foreign Application Priority Data

Mar. 12, 2014 (JP) ..... 2014-049362

(51) Int. Cl.
*B41J 2/14* (2006.01)
*B41J 2/16* (2006.01)

(52) U.S. Cl.
CPC ..... *B41J 2/14* (2013.01)

(58) Field of Classification Search
CPC ..... B41J 2/14; B41J 2/14024; B41J 2/14201; B41J 2/14233; B41J 2/14274
See application file for complete search history.

(56) References Cited

U.S. PATENT DOCUMENTS 5,657,062 A * 8/1997 Shiraishi et al. ..... 347/55

FOREIGN PATENT DOCUMENTS

JP 2001341298 12/2001

* cited by examiner

*Primary Examiner* — Juanita D Jackson
(74) *Attorney, Agent, or Firm* — Adams & Wilks

(57) ABSTRACT

A liquid jet head includes base plates, a first actuator plate and a second actuator plate separately arranged on one principal planes of the base plates, and configured to jet a liquid, first extracting electrodes electrically connected to first drive electrodes, on the one principal plane of the first base plate, and second extracting electrodes electrically connected to second drive electrodes, on the one principal plane of the second base plate. The second extracting electrodes are pulled out on the one principal plane through through holes formed in the base plates.

6 Claims, 18 Drawing Sheets

LIQUID JET HEAD AND LIQUID JET APPARATUS

BACKGROUND

1. Technical Field

The present invention relates to a liquid jet head and a liquid jet apparatus.

2. Related Art

Conventionally, there are ink jet printers (liquid jet apparatuses) including an ink jet head (liquid jet head) that ejects ink droplets through a plurality of nozzle holes toward a recording medium, as apparatuses that eject an ink in a liquid droplet manner (hereinafter, simply referred to as ink droplets) toward a recording medium to record images and characters.

The above-described ink jet head includes a head chip. The head chip described in JP 2001-341298 A includes a base plate made of glass or the like, and a plurality of partition walls made of a piezoelectric material and arrayed on the base plate. Channels that accommodate the ink are defined between respective partition walls, for example. Drive electrodes are formed on side surfaces of the partition walls, and are electrically connected to an extracting electrode formed on the base plate. Further, a flexible print substrate is connected to the extracting electrode at an outside of the partition walls.

According to the configuration, when a voltage is applied to the drive electrodes through the flexible substrate and the extracting electrode, the partition walls are deformed, so that pressure in the channels is increased, and the ink accommodated in the channels are ejected through the nozzle holes.

Further, in recent years, to improve density of the characters and images recorded on the recording medium, various technologies to increase the number of nozzle holes have been proposed. For example, in JP 2001-341298 A, a configuration in which base plates of a first head chip and of a second head chip are bonded, and high density recording is provided, is discussed.

SUMMARY

However, in the configuration of JP 2001-341298 A, the extracting electrodes are formed on the base plates of the head chips, and thus the flexible print substrates need to be separately connected to the extracting electrode of the first head chip and to the extracting electrode of the second head chip. Therefore, the number of parts is increased, and complexity of the configuration may be incurred.

Further, in the ink jet head in a so-called three-cycle system, like the configuration of JP 2001-341298 A, in which the ink is accommodated in the channels and is sequentially ejected through the channels, the drive electrodes are short-circuited through the ink when an ink having conductivity such as an aqueous ink is used. Therefore, the configuration of JP 2001-341298 A cannot support various inks, and there is room for improvement in terms of improvement of convenience.

The present invention has been made in view of the foregoing, and provides a liquid jet head and a liquid jet apparatus that can provide high density recording with reduction of the number of parts and simplification of the configuration.

The present invention provides following means in order to solve the above problems.

The liquid jet head according to the present invention includes: a base plate; a first actuator portion and a second actuator portion separately arranged on a first principal plane and a second principal plane of the base plate, and configured to jet a liquid; a first drive electrode and a second drive electrode separately formed on the first actuator portion and the second actuator portion, and configured to respectively drive the first actuator portion and the second actuator portion; a first extracting electrode electrically connected to the first drive electrode on the first principal plane of the base plate; and a second extracting electrode electrically connected to the second drive electrode on the second principal plane of the base plate, wherein the second extracting electrode is pulled out on the first principal plane through a through hole formed in the base plate.

According to the configuration, the second extracting electrode is pulled out on the first principal plane through the through hole. Therefore, external wiring such as a flexible print substrate is connected only to the first principal plane of the base plate, whereby electrical conduction between the actuator portions and the external wiring can be secured. Therefore, the configuration can realize high density recording with reduction in the number of parts and simplification of the configuration, compared with a conventional configuration in which external wiring is separately connected to both of the principal planes of the base plates, with respect to the actuator portions.

Further, in the liquid jet head according to the present invention, the base plate may include a first plate to which the first actuator portion is fixed, and a second plate to which the second actuator portion is fixed, and bonded to the first plate, and the through hole may include a plurality of first through holes formed in the first plate, and a plurality of second through holes formed in the second plate, arrayed with an equal pitch to the first through holes, and separately communicating to the first through holes.

According to the configuration, the first through hole and the second through hole are arrayed at an equal pitch between the plates, whereby the first through hole and the second through hole can be used as a reference for positioning when the plates are bonded. As a result, the first through hole and the second through hole can be caused to reliably communicate to each other, with the simplification of the configuration. Further, the second extracting electrode can be pulled out on the first principal plane of the base plate.

Further, in the liquid jet head according to the present invention, a space between the first extracting electrode and the second extracting electrode may become wider as being separated from the first actuator portion, on the first principal plane.

According to the configuration, short circuit between the first extracting electrode and the second extracting electrode can be suppressed and electrical reliability can be secured on the first principal plane.

Further, in the liquid jet head according to the present invention, the first actuator portion and the second actuator portion may separately include a plurality of channel blocks arranged in parallel with a space, a jet channel in which the liquid is filled may be formed in the channel block, and a portion defined by the adjacent channel blocks and the base plate may configure a dummy channel in which the liquid is not filled, the first drive electrode and the second drive electrode may avoid a portion defined by the base plate, of an inner surface of the dummy channel, and may separately include individual electrodes formed on facing surfaces of the adjacent channel blocks, and the base plate may include an electrode forming region in which the first extracting electrode and the second extracting electrode are formed, and a non-forming region that includes at least the portion that defines the dummy channel, and has smaller surface roughness than the electrode forming region.

According to the configuration, when the drive electrodes and the extracting electrodes are formed by plating, it can be set that a plated film is educed on the electrode forming region by anchor effect, and the plated film is not educed on the non-forming region, of the base plate.

In this case, the portion that defines at least the dummy channel (that is, the potion that configures the bottom surface of the dummy channel) is caused to be the non-forming region, of the base plate, so that the plated film is not educed on the portion that defines the dummy channel. Therefore, when the individual electrodes are formed by plating, it can be set that the plated film is educed only on the side wall surfaces (the facing surfaces of the channel block), and the plated film is not educed on the bottom surface (the portion positioned between the channel blocks, of the base plate), of the inner surface of the dummy channel. Accordingly, it is not necessary to remove the plated film educed on the bottom surface of the dummy channel by a laser or the like. Therefore, manufacturing cost can be reduced, and refuse generated in post steps can be reduced. In addition, the short circuit of the individual electrodes, which are formed on the side wall surfaces of the dummy channel, can be reliably prevented.

Further, in the liquid jet head according to the present invention, the base plate may be formed of a glass material.

According to the configuration, the base plate is configured from the glass material. Therefore, the surface roughness of the non-forming region can be suppressed small. In this case, when the drive electrodes and the extracting electrodes are formed by plating, formation of the plated film on the non-forming region can be suppressed. As a result, a patterning step after the formation of the plated film becomes unnecessary, and efficiency of manufacturing process steps can be enhanced, and reduction in cost can be achieved.

Further, the liquid jet apparatus according to the present invention includes a liquid jet head of the present invention, and a moving mechanism that relatively moves the liquid jet head and a recording medium.

The configuration includes the liquid jet head of the present invention is included, and thus can support the high density recording, and provide a liquid jet apparatus excellent in reliability.

According to the present invention, the high density recording can be provided with reduction in the number of parts and simplification of the configuration.

BRIEF DESCRIPTION OF DRAWINGS

FIG. 11A illustrates the first head chip side and FIG. 11B illustrates the second head chip side;

FIG. 12A illustrates the first head chip side and FIG. 12B illustrates the second head chip side;

FIG. 13A illustrates the first head chip side and FIG. 13B illustrates the second head chip side;

FIG. 14B illustrates the second head chip side;

FIG. 18A illustrates the first head chip side and FIG. 18B illustrates the second head chip side;

FIG. 19A illustrates the first head chip side and FIG. 19B illustrates the second head chip side;

FIG. 20A illustrates the first head chip side and FIG. 20B illustrates the second head chip side.

DETAILED DESCRIPTION

Figure 1:
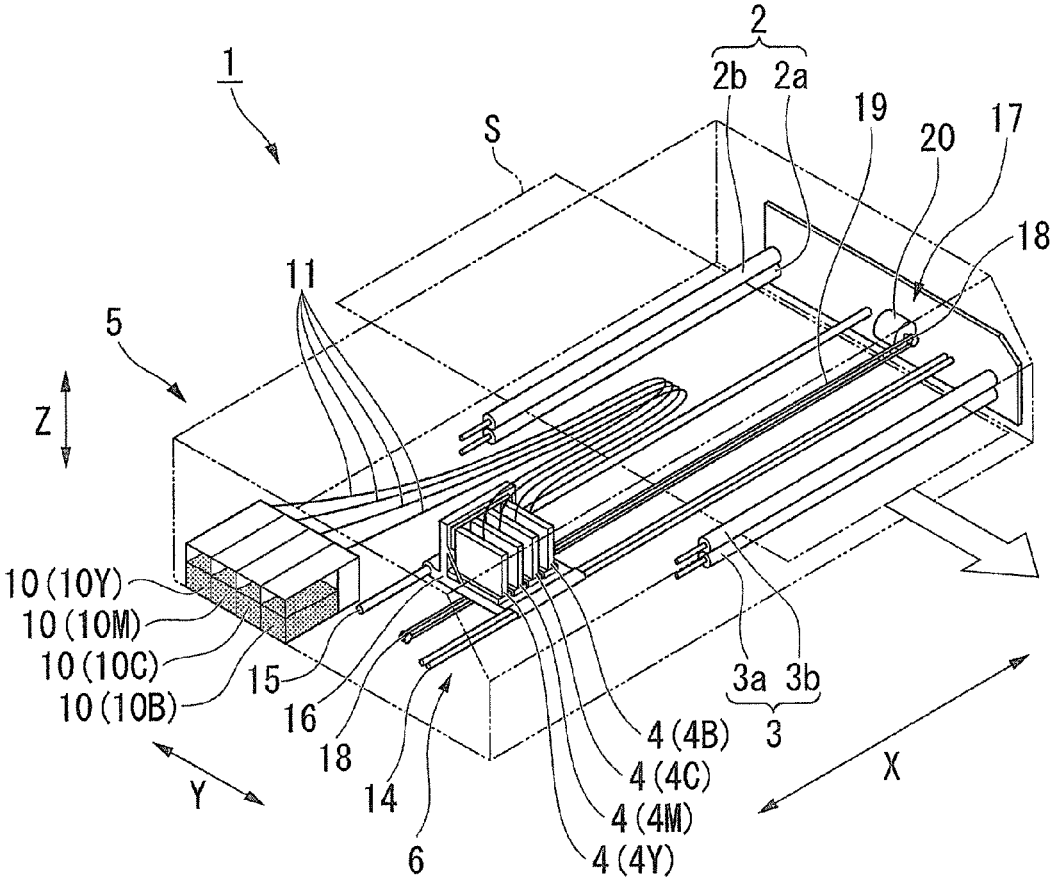
FIG. 1 is a perspective view of an ink jet printer in an embodiment.

Hereinafter, an embodiment of the present invention will be described with reference to the drawings. In the embodiment below, an ink jet printer (hereinafter, simply referred to as printer) that performs recording on a recording medium such as a recording paper using an ink (liquid) will be described as an example of a liquid jet apparatus including a liquid jet head of the present invention. Note that, in the drawings used for description, scales of members are appropriately changed so that the members can be recognized.

[Printer]

FIG. 1 is a perspective view of a printer 1.

As illustrated in FIG. 1, the printer 1 includes a pair of conveyance mechanisms (moving mechanisms) 2 and 3 that conveys a recording medium S such as a paper, an ink jet head 4 that jets ink droplets on the recording medium S, ink supply means 5 that supplies an ink to the ink jet head 4, and scanning means 6 that allows the ink jet head (liquid jet head) 4 to scan in a direction (sub-scanning direction perpendicular to a conveyance direction (main scanning direction) of the recording medium S.

Note that description below will be given, where the sub-scanning direction is an X direction, the main scanning direction is a Y direction, and a direction perpendicular to the X direction and the Y direction is a Z direction. Here, the printer 1 is placed and used such that the X direction and the Y direction become a horizontal direction, and the Z direction becomes a vertical direction.

The conveyance mechanisms 2 and 3 respectively include grid rollers 2*a* and 3*a* extending in the X direction, pinch rollers 2*b* and 3*b* extending in parallel to the grid rollers 2*a* and 3*a*, and drive mechanisms (not illustrated) such as motors that rotate the grid rollers 2*a* and 3*a* around its axes.

The ink supply means 5 includes an ink tank 10 that accommodates the ink, and ink piping 11 that connects the ink tank 10 and the ink jet head 4. A plurality of the ink tanks 10 is provided, and for example, ink tanks 10Y, 10M, 10C, and 10B that accommodate four types of inks: yellow, magenta, cyan, and black are arrayed along the Y direction. The ink piping 11 is a flexible hose having flexibility, and can follow operation (movement) of a carriage 16 that supports the ink jet head 4. Note that the ink tanks 10 are not limited to the ink tanks 10Y, 10M, 10C, and 10B that accommodate four types of inks: yellow, magenta, cyan, and black, and may include ink tanks that accommodate a larger number of colors.

The scanning means 6 includes a pair of guide rails 14 and 15 extending in the X direction and arranged in parallel to each other having a space in the Y direction, a carriage 16 arranged movable along the pair of guide rails 14 and 15, and a drive mechanism 17 that moves the carriage 16 in the X direction.

The drive mechanism 17 is arranged between the pair of guide rails 14 and 15, and includes a pair of pulleys 18 arranged having a space in the X direction, an endless belt 19 wound between the pair of pulleys 18 and moved in the X direction, and a drive motor 20 that rotates and drives one of the pulleys 18.

The carriage 16 is coupled to the endless belt 19, and is movable in the X direction with movement of the endless belt 19 rotated and driven by the one of the pulleys 18. Further, a plurality of ink jet heads 4 is mounted on the carriage 16 in a state of being aligned in the X direction. In the example of the drawing, the four ink jet heads 4 that respectively eject the inks yellow (Y), magenta (M), cyan (C), and black (B), that is, ink jet heads 4Y, 4M, 4C, and 4B are mounted on the carriage 16. Note that the conveyance mechanisms 2 and 3, and the scanning means 6 configure the moving mechanism that relatively move the ink jet heads 4 and the recording medium S.

(Ink Jet Head)

Figure 2:
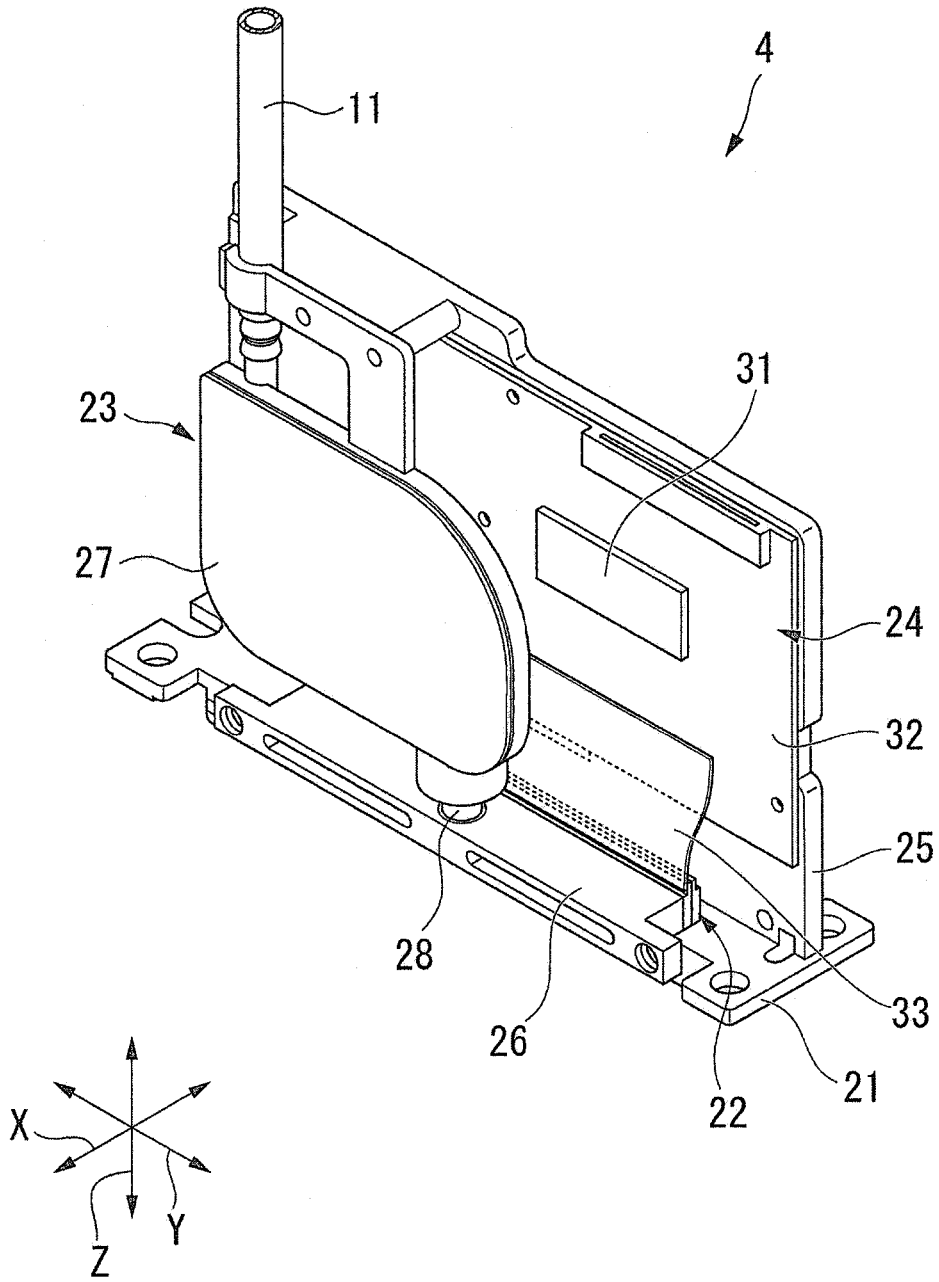
FIG. 2 is a perspective view of an ink jet head in the embodiment.

The ink jet head 4 will be described in detail. FIG. 2 is a perspective view of the ink jet head 4. Note that the ink jet heads 4 described above have the same configuration except the colors of the inks to be supplied. Therefore, in the following description, one ink jet head 4 will be described.

As illustrated in FIG. 2, the ink jet head 4 includes a fixing plate 21 fixed to the carriage 16, an ejecting portion 22 fixed on the fixing plate 21, an ink supply portion 23 that further supplies the ink, which is supplied from the ink supply means 5, to a common ink chamber 63 of the ejecting portion 22 described below, and a head drive portion 24 that applies a drive voltage to the ejecting portion 22.

The ink jet head 4 ejects the ink of each color with a predetermined ejection amount, by being applied the drive voltage. At this time, the ink jet head 4 is moved in the X direction by the scanning means 6, thereby to perform recording on a predetermined range of the recording medium S. This scanning is repeatedly performed while the recording medium S is conveyed in the Y direction by the conveyance mechanisms 2 and 3, whereby the recording can be performed on the entire recording medium S.

A support plate 25 made of metal such as aluminum is fixed to the fixing plate 21 in a state of rising along the Z direction, and a flow path member 26 that supplies the ink to the ejecting portion 22 is fixed to the fixing plate 21. A pressure buffer 27 having a storage chamber therein is arranged above the flow path member 26 in a state of being supported by the support plate 25. The storage chamber stores the ink. The flow path member 26 and the pressure buffer 27 are coupled through an ink connecting pipe 28, and the ink piping 11 of the ink supply means 5 is connected to the pressure buffer 27.

When the ink is supplied through the ink piping 11, the pressure buffer 27 once stores the ink in the storage chamber, and supplied a predetermined amount of the ink to the ejecting portion 22 through the ink connecting pipe 28 and the flow path member 26.

Note that the flow path member 26, the pressure buffer 27, and the ink connecting pipe 28 configure the ink supply portion 23.

An IC substrate 32, on which a control circuit (drive circuit) 31 such as an integrated circuit for driving the ejecting portion 22 is mounted, is attached to the support plate 25. The control circuit 31 is electrically connected to drive electrodes (a common electrode 55, a common terminal 56, an individual electrode 57, and an individual terminal 58) of the ejecting portion 22 through a flexible print substrate 33 on which a wiring pattern (not illustrated) is printed. Accordingly, the control circuit 31 can apply the drive voltage to the drive electrodes 55 to 58 through the flexible print substrate 33.

The IC substrate 32 on which the control circuit 31 is mounted and the flexible print substrate 33 configure the head drive portion 24.

(Ejecting Portion)

Figure 3:
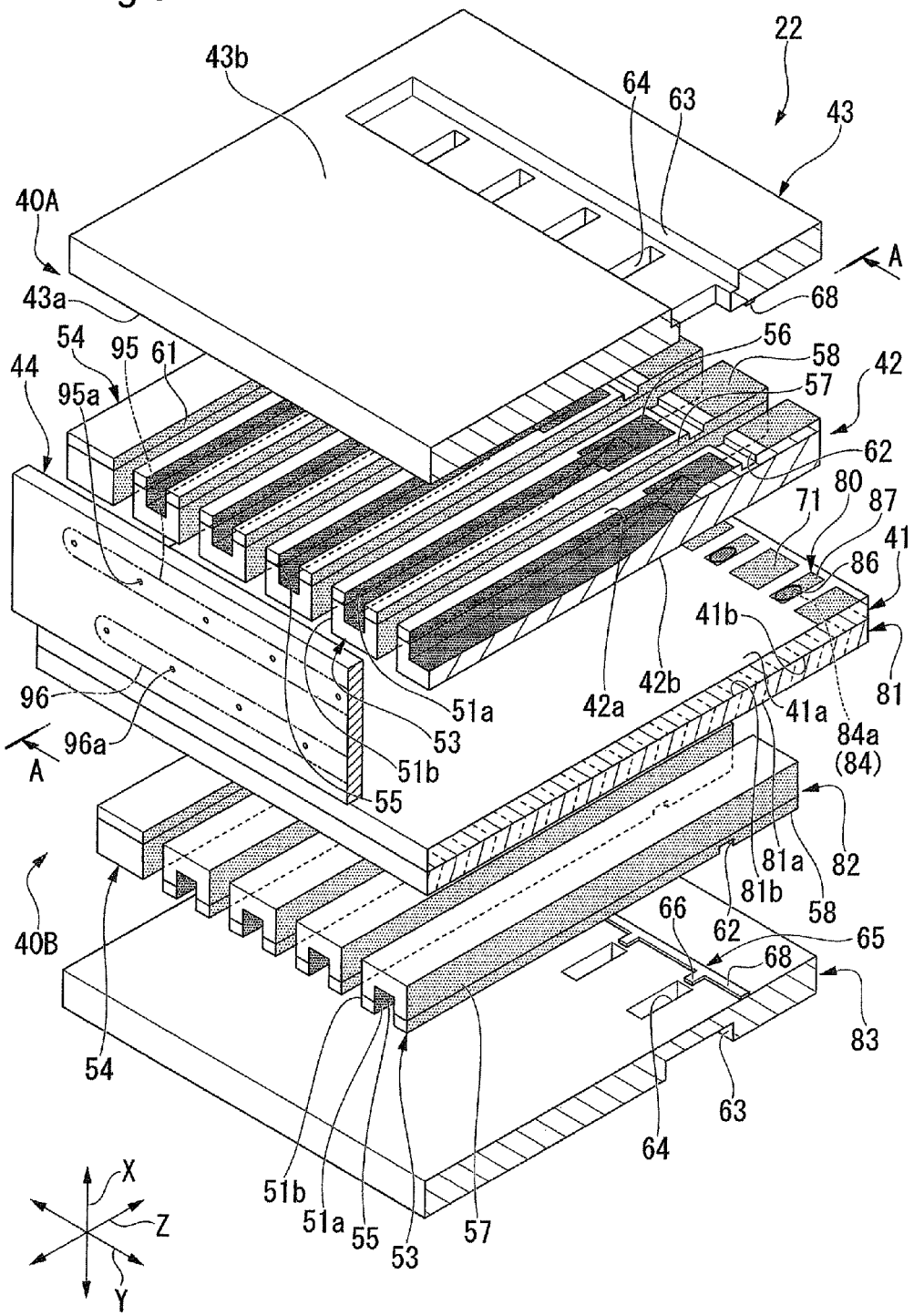
FIG. 3 is an exploded perspective view of an ejecting portion as viewed from one side of a Z direction.
Figure 4:
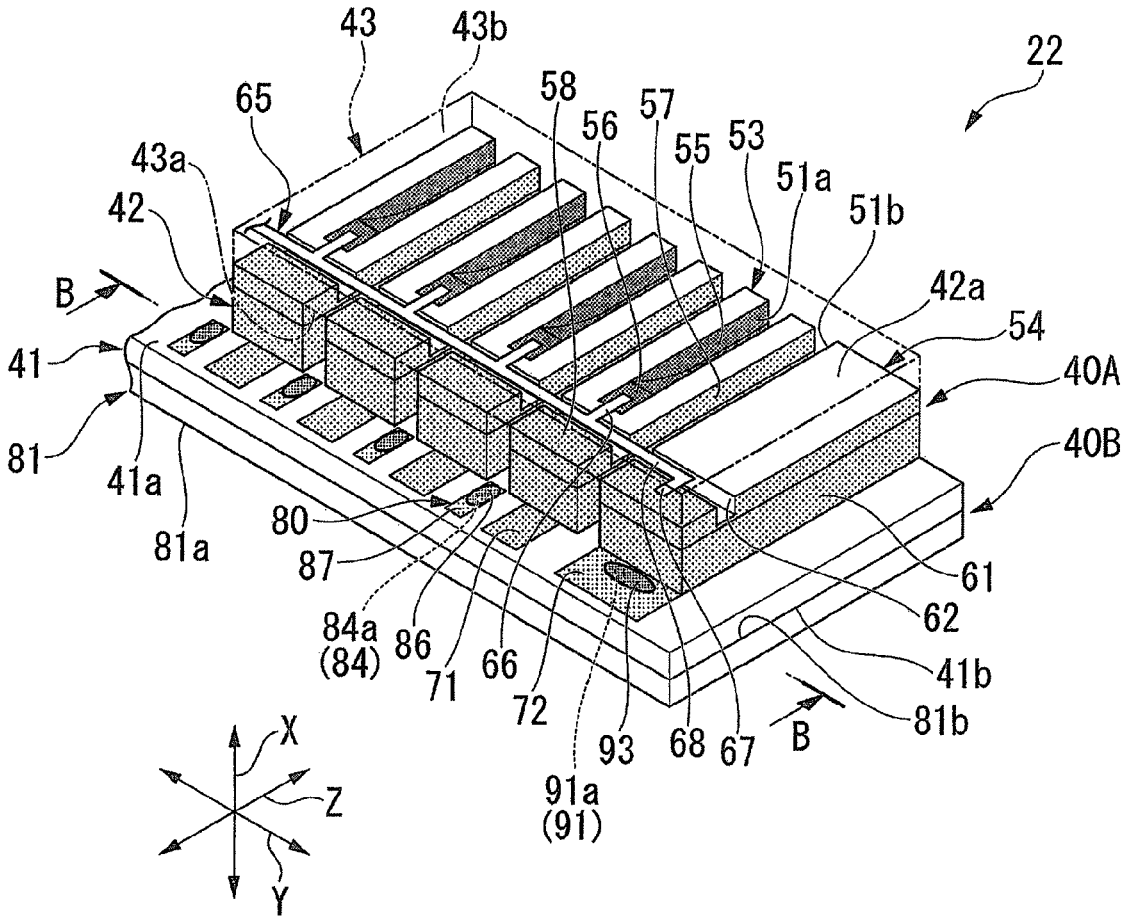
FIG. 4 is a perspective view of the ejecting portion as viewed from a first head chip side.
Figure 5:
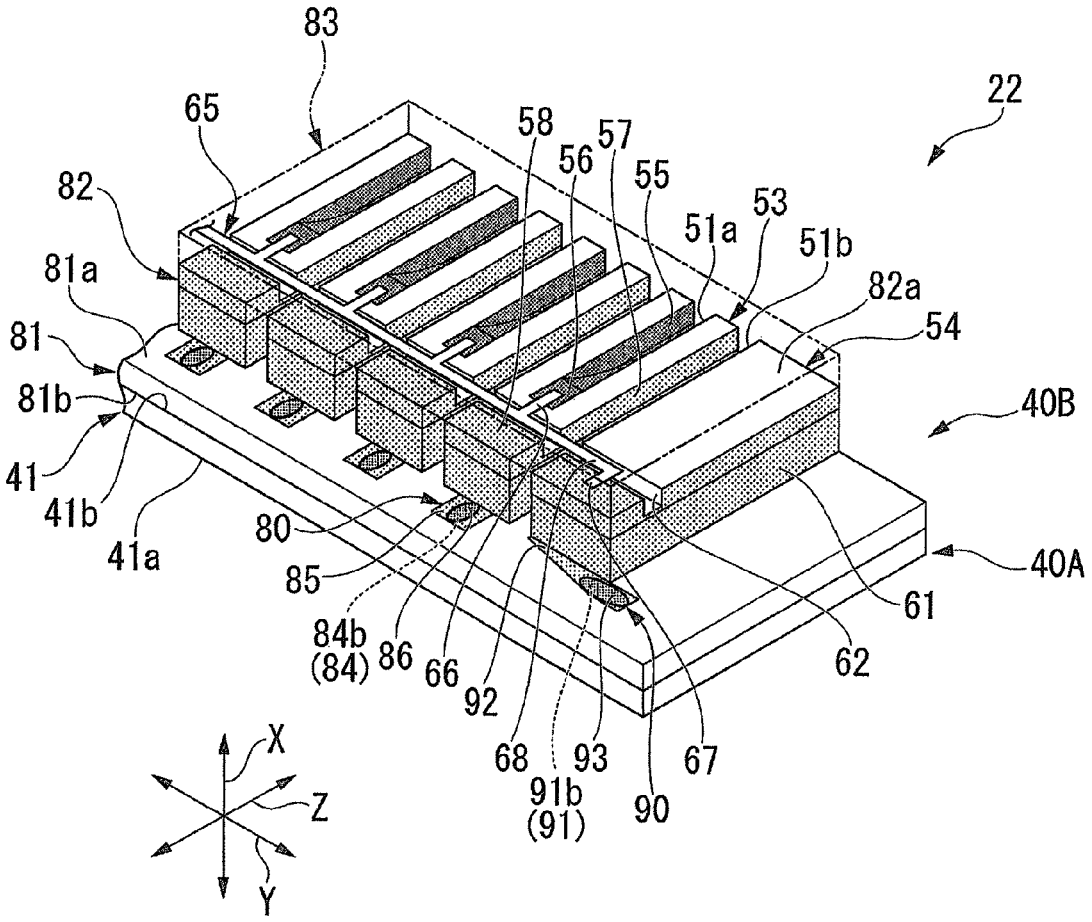
FIG. 5 is a perspective view of the ejecting portion as viewed from a second head chip side.
Figure 6:
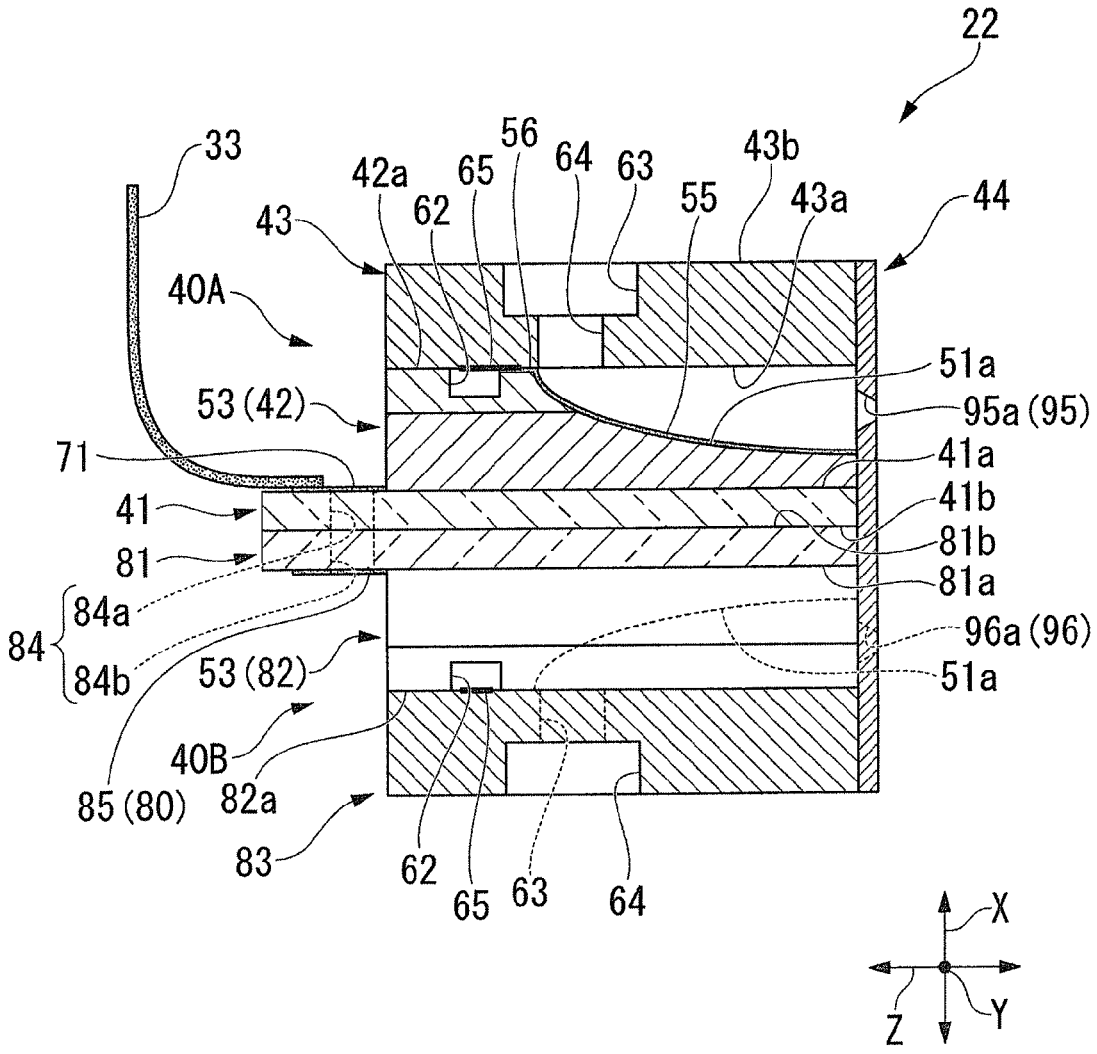
FIG. 6 is a cross sectional view corresponding to an A-A line of FIG. 3.
Figure 7:
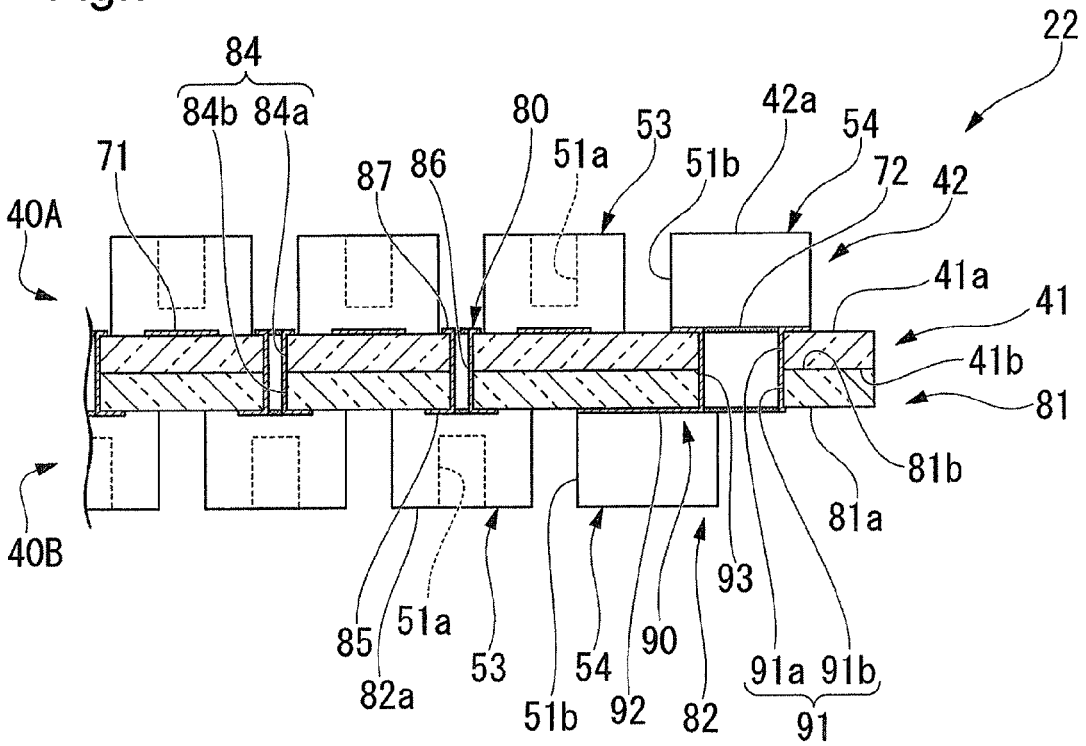
FIG. 7 is a cross sectional view corresponding to a B-B line of FIG. 4.

Next, the ejecting portion 22 will be described in detail. FIG. 3 is a perspective view of the ejecting portion 22 as viewed from one side of the Z direction. FIG. 4 is a perspective view of the ejecting portion 22 as viewed from a first head chip 40A side. FIG. 5 is a perspective view of the ejecting portion 22 as viewed from a second head chip 40B side. FIG. 6 is a cross sectional view corresponding to an A-A line of FIG. 3. FIG. 7 is a cross sectional view along a B-B line of FIG. 7.

As illustrated in FIGS. 3 to 7, the ejecting portion 22 of the present embodiment is a two-array type ejecting portion 22 in which nozzle arrays 95 and 96 made of a plurality of nozzle holes (first nozzle holes 95*a* and second nozzle holes 96*a*) are formed over two arrays. To be specific, the ejecting portion 22 includes a first head chip 40A and a second head chip 40B laminated in the X direction, and a nozzle plate 44 fixed to both of the first head chip 40A and the second head chip 40B. Note that, in the description below, a nozzle plate 44 side, of the Z direction, will be referred to as front side, and an opposite side to the nozzle plate 44 will be referred to as rear side. Further, the head chips 40A and 40B are so-called edge-shoot type head chips that eject the inks from ejection channels 51*a* described below.

(First Head Chip)

The first head chip 40A includes a first base plate (a base plate or a first plate) 41, a first actuator plate (first actuator portion) 42, and a first cover plate 43.

The first base plate 41 is configured from a dielectric such as glass.

The first actuator plate 42 is a laminate plate formed such that two plates having different polarization directions in a thickness direction (X direction) are laminated (a so-called Chevron-type actuator plate). These two plates are piezoelectric substrates, for example, PZT (lead zirconate titanate) ceramic substrates, subjected to polarization processing in the thickness direction (X direction), and are bonded in a state in which mutual polarization directions face opposite directions.

The first actuator plate 42 is fixed to a position that avoids through holes 84 and 91 described below, of on the first base plate 41, with an adhesive or the like, in a state in which a front end surface is arranged flush with a front end surface of the first base plate 41. In planer view as viewed from the X direction, an external shape of the first actuator plate 42 is smaller than that of the first base plate 41. Therefore, both sides and rear end portions in the Y direction of the first base plate 41 protrude more outside than the first actuator plate 42.

A plurality of channels 51*a* and 51*b* depressed in the X direction is arranged in parallel in the first actuator plate 42 with a predetermined space in the Y direction. The plurality of channels 51*a* and 51*b* is open to a side of a principal plane 42*a* that is one of principal planes of the first actuator plate 42, and extends along the Z direction in a linear manner.

To be specific, the plurality of channels 51*a* and 51*b* is roughly classified into ejection channels (jet channels) 51*a* in which the ink is filled, and dummy channels 51*b* in which the ink is not filled. These ejection channels 51*a* and dummy channels 51*b* are alternately arranged in the Y direction.

The dummy channels 51*b* penetrate the first actuator plate 42 in the X direction and the Z direction, and divide the first actuator plate 42 into parts in the Y direction. Note that a portion positioned between the dummy channels 51*b* adjacent in the Y direction, of the first actuator plate 42, configures a center block (channel block) 53, and portions positioned at outsides in the Y direction of the dummy channels 51*b* positioned at outermost ends in the Y direction configure a pair of outer side blocks 54. In the example of the drawing, only one outer side block 54 of the pair of outer side blocks 54 is illustrated.

Meanwhile, the ejection channels 51*a* are separately formed in the center blocks 53 in a state of being open to the X and Z directions of the first actuator plate 42. Therefore, drive walls that define the ejection channel 51*a* are formed on both sides of each center block 53 in the Y direction with respect to the ejection channel 51*a*. The drive walls have a rectangular shape in the cross section, and extend in the Z direction. With the drive walls, the ejection channels 51*a* and the dummy channels 51*b* are divided. Note that, in the example of the drawing, rear end portions of the ejection channels 51*a* become shallower as going to the rear side.

The common electrode 55 is formed on an inner surface of the ejection channel 51*a*, that is, on a pair of side wall surfaces facing each other in the Y direction, and a bottom wall surface. The common electrode 55 extends along the ejection channel 51*a* in the Z direction, and is conducted to the common terminal 56 formed on the one principal plane 42*a* of the center block 53. Note that the common terminals 56 are patterned and formed electrically independent from each other.

Meanwhile, the individual electrodes 57 are respectively formed on the entire outer side surfaces of the center blocks 53 (the pair of side wall surfaces facing in the Y direction, of the inner surface of the dummy channel 51*b*). These individual electrodes 57 are connected to the individual terminal 58 (see FIG. 4) formed on the one principal plane 42*a* and on a rear end surface of the center block 53, at the rear end portion of the center block 53. Therefore, the pair of individual electrodes 57 formed on the outer side surfaces of one center block 53 are connected through the individual terminal 58. Note that the individual electrodes 57 are not formed on the bottom wall surface (on the base plate 41) of the inner surface of the dummy channel 51*b*, and are separated between the pair of side wall surfaces facing in the Y direction. Note that the common electrode 55, the common terminal 56, the individual electrodes 57, and the individual terminal 58 configure the drive electrode (first drive electrode) 55 to 58 of the first head chip 40A.

Further, a ground terminal 61 is formed on an outer surface of the outer side block 54. Note that, in the example of the drawing, the ground terminal 61 is formed on one principal plane 42*a*, an outer side surface, and a rear end surface of the outer side block 54. However, the ground terminal 61 may just be formed on at least the one principal plane 42*a* and the rear end surface.

Further, a groove portion 62 extending along the Y direction is formed in a portion positioned between the common terminal 56 and the individual terminal 58, in the one principal plane 42*a* of the first actuator plate 42 (the center block 53 and the outer side block 54). The groove portion 62 is depressed in the Z direction, and divides the common terminal 56 and the individual terminal 58.

As illustrated in FIGS. 3 and 6, one principal plane 43*a* of the first cover plate 43 is bonded to the one principal plane 42*a* of the first actuator plate 42. Note that, if a rear end side of the first actuator plate 42 is exposed, a crack or a defect is caused in the first actuator plate 42 at the rear end side when the first head chip 40A collides with a jig or the like of manufacturing by mistake, and the individual terminal 58 may be disconnected. To prevent this problem, the first cover plate 43 has a shape flush with the first actuator plate 42 on a ZY plane, and an external shape of the first cover plate 43 in planar view as viewed from the X direction accords with the external shape of the entire first actuator plate 42 (the center block 53 and the outer side block 54) in planar view as viewed from the X direction. That is, on the ZY plane, the first cover plate 43 covers the rear end side of the first actuator plate 42. Further, the first cover plate 43 includes the common ink chamber 63 having a recessed shape and formed at the other principal plane 43*b* side, and a plurality of slits 64 that allows the common ink chamber 63 and the ejection channels 51*a* to separately communicate to each other.

The common ink chamber 63 is a rectangular opening depressed in the first actuator plate 42 side in the X direction and extending along the Y direction, and positioned at a rear end portion of the first cover plate 43. The common ink chamber 63 communicates to the flow path member 26 (see FIG. 2), and is configured to allow the ink in the flow path member 26 to circulate in the common ink chamber 63.

The slits 64 are formed at positions corresponding to the ejection channels 51*a*, of the common ink chamber 63. To be specific, the slit 64 has a predetermined length in the Z direction, and a rear end edge of the slit 64 in the Z direction accords with a rear end edge of the ejection channel 51*a* (an envelope-shaped end point of the ejection channel 51*a*) (see FIG. 6). Accordingly, the slit 64 is configured to introduce the ink in the common ink chamber 63 into the ejection channel 51*a*, and to regulate introduction of the ink into the dummy channel 51*b*. Note that, with the specific arrangement of the slits 64, the ink is not stagnated at the rear end side of the ink ejection channels 51*a*, and thus accumulation of bubbles in the ejection channels 51*a* can be prevented.

As illustrated in FIGS. 3 and 4, connection wiring 65 that connects the common terminals 56 and the ground terminals 61 is formed on the one principal plane 43*a* of the first cover plate 43. To be specific, the connection wiring 65 includes common connection portions 66 separately connected to the common terminals 56, ground connection portions 67 separately connected to the ground terminals 61, and main wiring 68 that connects the common connection portions 66 and the ground connection portions 67.

The main wiring 68 is formed on a portion overlapping with the groove portion 62 of the first actuator plate 42 in the X direction, of the first cover plate 43, and has a belt shape extending along the Y direction. Note that the main wiring 68 is formed over nearly the entire first cover plate 43 in the Y direction to bridge the pair of outer side blocks 54 in the first actuator plate 42. Further, the width of the connection wiring 65 (the width in the Z direction) is narrower than the width of the groove portion 62, and is away from the first actuator plate 42.

The common connection portions 66 are arrayed with a space in the Y direction, and extend in parallel to each other in the Z direction. In this case, an array pitch of the common connection portions 66 in the Y direction is equal to an array pitch of the ejection channels 51*a*. While front end portions of the common connection portions 66 are respectively connected to corresponding common terminals 56, rear end portions are collectively connected to the main wiring 68.

The ground connection portions 67 extend from both end portions of the main wiring 68 of the Y direction to a rear side, and rear end portions are respectively connected to corresponding ground terminals 61, on the one principal plane 42*a* of the outer side block 54.

Here, as illustrated in FIGS. 3 to 7, on one principal plane (first principal plane) 41*a* of the first base plate 41, first extracting electrodes (a first individual extracting electrode 71 and a first ground extracting electrode 72) separately connected to the individual terminals 58 and the ground terminals 61 are formed on portions positioned at a more rear side than the first actuator plate 42.

The first individual extracting electrodes 71 are arrayed with a space in the Y direction, and extend in parallel to each other in the Z direction. In this case, an array pitch of the first individual extracting electrodes 71 in the Y direction is equal to the array pitch of the center blocks 53. Front end portions of the first individual extracting electrodes 71 are respectively connected to corresponding individual terminals 58, and rear end portions are drawn to a position adjacent to a rear end edge of the base plate 41.

Front end portions of the first ground extracting electrodes 72 are respectively connected to corresponding ground terminals 61, and rear end portions are drawn to a position adjacent to the rear end edge of the base plate 41. Note that, in the example of the drawing, the width of the first individual extracting electrode 71 in the Y direction is narrower than the width of the center block 53, and the width of the ground extracting electrode 72 in the Y direction is equal to the outer side block 54.

Note that the area of the first ground extracting electrode 72 is larger than the area of the first individual extracting electrode 71, and as illustrated in FIG. 4, the length of the first ground extracting electrode 72 and the length of the first individual extracting electrode 71 are equal in the Z direction, and the length of the first ground extracting electrode 72 is longer than the length of the first individual extracting electrode 71 in the Y direction.

Further, the drive electrodes 55 to 58, the ground terminals 61, and the first extracting electrodes 71 and 72 are integrally formed with a plated film 120 (see FIG. 16) made of Ni/Au, or the like. Here, surface roughness Ra of electrode forming regions where the first extracting electrodes 71 and 72 are formed is larger than surface roughness Ra of a region (non-forming region) other than the electrode forming regions, on the one principal plane 41*a* of the first base plate 41. In this case, it is favorable that the surface roughness Ra of the electrode forming region has a size with which the plated film 120 can be formed, and is 400 Å or more. Meanwhile, it is desirable that the surface roughness Ra of the non-forming region has a size with which the plated film cannot be formed and is less than 100 Å. That is, in the present embodiment, the surface roughness Ra of the electrode forming region is favorably four times the surface roughness Ra of the non-forming region. Note that, in the present embodiment, the surface roughness Ra is a numerical value of an arithmetic mean roughness Ra standardized in JIS B0601.

(Second Head Chip)

The second head chip 40B includes a second base plate (a base plate or a second plate) 81, a second actuator plate (second actuator portion) 82, and a second cover plate 83. Note that a similar configuration of the second head chip 40B to the first head chip 40A is denoted with the same reference sign, and description is omitted.

Another principal plane 41*b* and 81*b* of the base plates 41 and 81 are bonded, so that the first head chip 40A and the second head chip 40B are laminated in the X direction. That is, the first actuator plate 42 and the second actuator plate 82 are respectively arranged to the first base plate 41 and the second base plate 81 at both sides in the X direction, in the ejecting portion 22 of the present embodiment.

Center blocks 53 and outer side blocks 54 of the second actuator plate 82 are arrayed to be shifted by a half pitch with respect to the array pitch of the center blocks 53 and the outer side blocks 54 of the first actuator plate 42. Therefore, ejection channels 51*a* and dummy channels 51*b* of the second head chip 40B are also arrayed to be shifted by a half pitch with respect to the ejection channels 51*a* and the dummy channels 51*b* of the first head chip 40A. That is, in the ejecting portion 22 of the present embodiment, the ejection channels 51*a* of the first actuator plate 42 and the ejection channels 51*a* of the second actuator plate 82 are arranged in a zigzag manner. Note that drive electrodes (second drive electrodes) 55 to 58 and ground terminals 61, which are similar to those of the first actuator plate 42, are formed on the second actuator plate 82.

Here, as illustrated in FIGS. 5 to 7, a second individual extracting electrode 80 of the second head chip 40B is pulled around on the one principal plane 41*a* of the first base plate 41 through the individual through hole (through hole) 84 that penetrates the first base plate 41 and the second base plate 81. To be specific, the second individual extracting electrode 80 includes an extracting portion 85 formed on a principal plane (second principal plane) 81*a* of the second base plate 81, a through hole 86 formed in the individual through hole 84, and a land portion 87 formed on the one principal plane 41*a* of the first base plate 41.

First, the individual through hole 84 has an elliptical shape having the Y direction as a minor axis, and is open at a rear side of the dummy channel 51*b* (between the first individual extracting electrodes 71 in the Y direction) on the first base plate 41 and is open at a rear side of the center block 53 on the second base plate 81. To be specific, the individual through hole 84 includes a first through hole 84*a* that penetrates the first base plate 41, and a second through hole 84*b* that penetrates the second base plate 81 and has an array pitch in the Y direction equal to the first through hole 84*a*. The first through hole 84*a* and the second through hole 84*b* that are corresponding in the Y direction overlap with each other in the X direction, so that the individual through hole 84 that penetrates both of the base plates 41 and 81 in the X direction is formed. Note that the width of the individual through hole 84 in the Y direction is equal to the width of the dummy channel 51*b*.

The through portion 86 that penetrates the base plates 41 and 81 in the X direction is formed in the inner surface of each individual through hole 84 with the plated film 120.

The extracting portions 85 are arrayed on the one principal plane 81*a* of the second base plate 81 with a space in the Y direction, and extend in parallel to each other in the Z direction. To be specific, front end portions of the extracting portion 85 are respectively connected to corresponding individual terminals 58. Further, the extracting portion 85 surrounds the individual through hole 84 (second through hole 84*b*), and is connected to the through portion 86. Note that the array pith of the extracting portions 85 in the Y direction is equal to the array pitch of the center blocks 53.

The land portion 87 is positioned between the first individual extracting electrodes 71 adjacent in the Y direction, on the one principal plane 41*a* of the first base plate 41, and extend from the through portion 86 toward the rear side. Therefore, on the one principal plane 41*a* of the first base plate, the first individual extracting electrodes 71 and the land portions 87 of the second individual extracting electrodes 80 are alternately arrayed.

Further, as illustrated in FIGS. 5 and 7, a second ground extracting electrode 90 of the second head chip 40B is pulled around on the one principal plane 41*a* of the first base plate 41 through the ground through hole (through hole) 91 that penetrates the first base plate 41 and the second base plate 81. To be specific, the second ground extracting electrode 90 includes an extracting portion 92 formed on the one principal plane 81*a* of the second base plate 81, and a through portion 93 formed in the ground through hole 91.

The ground through hole 91 has an elliptical shape having the Y direction as a major axis, and is open at a rear side (a position equal to each ground extracting electrode 72 in the Y direction) of the outer side block 54 on the first base plate 41 and is open in a state where a part of the ground through hole 91 is more shifted in the Y direction than the outer side block 54 on the second base plate 81. To be specific, the ground through hole 91 includes a first through hole 91*a* that penetrates the first base plate 41, and a second through hole 91*b* that penetrates the second base plate 81 and has an array pitch in the Y direction equal to the first through hole 91*a*. The first through hole 91*a* and the second through hole 91*b* that are corresponding in the Y direction overlap with each other in the X direction, so that the ground through hole 91 that penetrates both of the base plates 41 and 81 in the X direction is formed.

The through portion 93 that penetrates the base plates 41 and 81 in the X direction is formed in the inner surface of each ground through hole 91 with the plated film 120. One end portion of the through portion 93 in the X direction is connected to the first ground extracting electrode 72 on the one principal plane 41*a* of the first base plate 41, and the other end portion is connected to the extracting portion 92 on the one principal plane 81*a* of the second base plate 81.

One end portions of the extracting portions 92 are respectively connected to corresponding ground terminals 61 on the one principal plane 81*a* of the second base plate 81, and the other end portions are connected to the through portion 93.

As illustrated in FIG. 6, the flexible print substrate 33 is connected to the rear end portion of the first base plate 41.

A wiring pattern (not illustrated) is formed on the flexible print substrate 33, and the wiring pattern is connected to the first individual extracting electrode 71, the first ground extracting electrode 72, and the land portion 87 of the second individual extracting electrode 80, on the one principal plane 41*a* of the first base plate 41. In this case, the flexible print substrate 33 is conducted to the second ground extracting electrode 90 through the first ground extracting electrode 72.

The nozzle plate 44 is formed into a film shape made of a resin material such as polyimide, and is fixed to the front end surfaces of the first head chip 40A and the second head chip 40B by an adhesive or the like. The two nozzle arrays (the first nozzle array 95 and the second nozzle array 96) made of a plurality of nozzle holes (the first nozzle holes 95*a* and the second nozzle holes 96*a*) arranged in parallel with a space in the Y direction are arranged in the nozzle plate 44.

The first nozzle array 95 includes the plurality of first nozzle holes 95*a* that penetrates the nozzle plate 44 in the Z direction, and these first nozzle holes 95*a* are arranged in a straight line with a space in the Y direction. The first nozzle holes 95*a* communicate to the ejection channels 51*a* of the first actuator plate 42.

The second nozzle array 96 includes the plurality of second nozzle holes 96*a* that penetrates the nozzle plate 44 in the Z direction, and is provided in parallel to the first nozzle array 95. The second nozzle holes 96*a* communicate to the ejection channels 51*a* of the second actuator plate 82. Therefore, the dummy channels 51*b* do not communicate to the nozzle holes 95*a* and 96*a*, and are covered with the nozzle plate 44 from a front side.

<Method of Operating Ink Jet Head>

Next, a method of operating the ink jet head 4 will be described.

In the ink jet head 4, the drive voltage is applied to the drive electrodes 55 to 58 through the flexible print substrate 33, so that the two drive walls that define the ejection channel 51*a* are deformed to protrude to the dummy channel 51*b* side by the piezoelectric slide effect. That is, the actuator plates 42 and 82 of the present embodiment are formed such that two plates subjected to the polarization processing are laminated in the thickness direction (X direction), and thus, by application of the drive voltage, the drive walls are bent and deformed in a V shaped manner around a central position in the X direction. Accordingly, the ejection channel 51*a* is deformed as if it swelled out.

When the volume of the ejection channel 51*a* is increased by the deformation of the two drive walls, the ink in the common ink chamber 63 passes through the slit 64 and is guided to the ejection channel 51*a*. Then, the ink guided to the inside of the ejection channel 51*a* becomes a pressure wave and is propagated in the inside of the ejection channel 51*a*. At timing when the pressure wave reaches the nozzle holes 95*a* and 96*a*, the drive voltage applied to the drive electrodes 55 to 58 are turned to zero.

Accordingly, the drive walls are restored, and the once increased volume of the ejection channel 51*a* is put back to an original volume. By the operation, the pressure inside the ejection channel 51*a* is increased, and the ink is pressurized. As a result, the ink can be ejected through the nozzle holes 95*a* and 96*a*. At this time, the ink becomes ink droplets before passing through the nozzle holes 95*a* and 96*a*, and is ejected.

Note that the method of operating the ink jet head 4 is not limited to the above content. For example, it may be configured such that the drive walls in a normal state are deformed into inner sides of the ejection channel 51*a* as if the ejection channel 51*a* was recessed inward. This can be realized such that positive and negative of the voltage applied to the drive electrodes 55 to 58 are made opposite to the above-described voltage, or the polarization directions of the piezoelectric elements of the actuator plates 42 and 82 are made opposite when the positive and negative of the voltage are not changed. Further, it may be configured such that the ejection channel 51*a* is deformed to swell out outward, and then is deformed to be recessed inward, so that welding pressure of the ink at the time of ejection is increased.

Further, in the ink jet head 4 of the present embodiment, the dummy channel 51*b* in which the ink is not filled is arranged between the each two ejection channels 51*a*. Therefore, the ink is ejected from all of the ejection channels 51*a* at once (so-called one cycle system). Further, the dummy channel 51*b* is arranged, and thus the drive electrodes 55 to 58 are not short-circuited through the ink. Therefore, various types of inks including the ink having conductivity such as an aqueous ink can be used, and there is an effect of being excellent in convenience.

<Method of Manufacturing Ink Jet Head>

Figure 8:
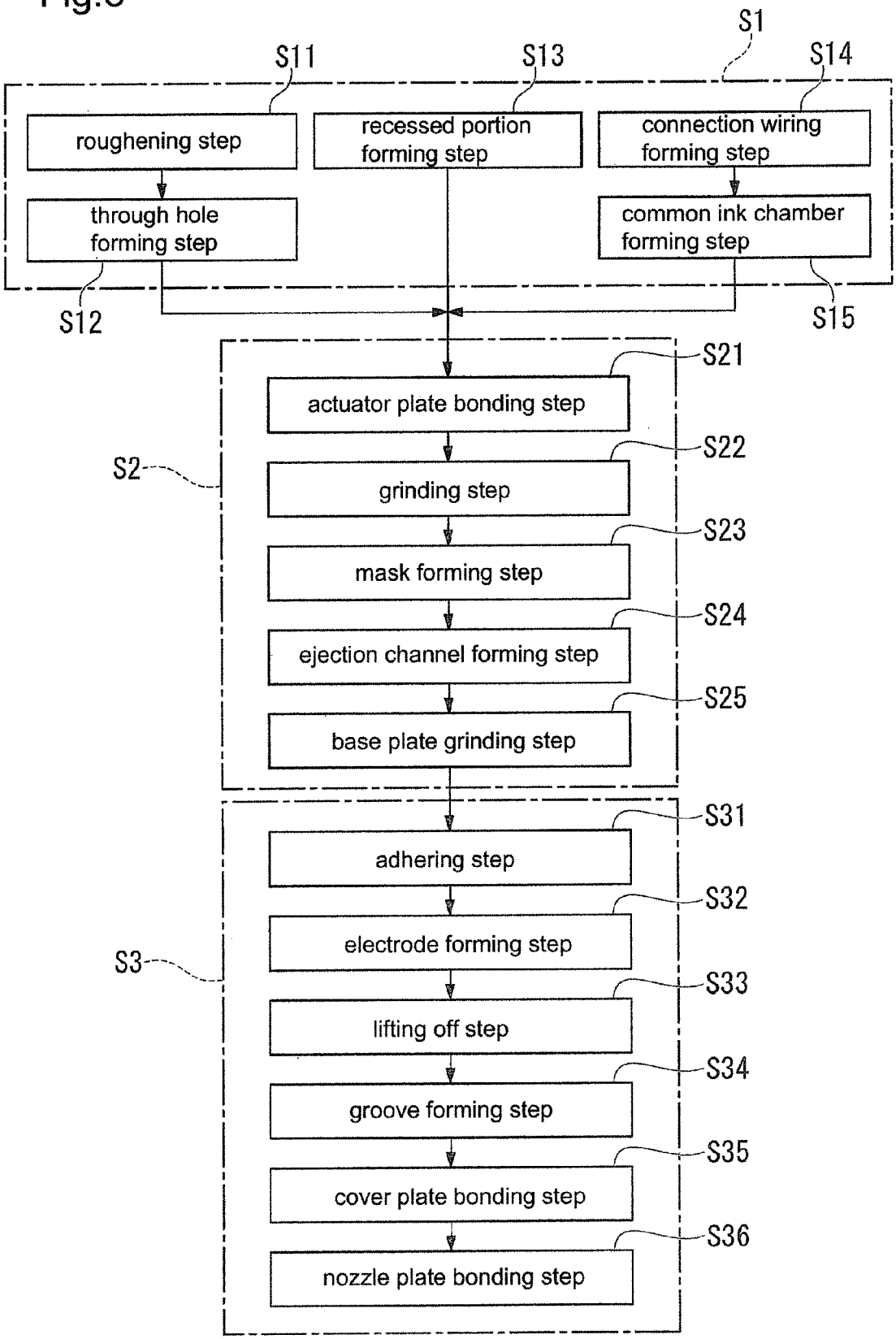
FIG. 8 is a flowchart for describing a method of manufacturing the ink jet head.

Next, a method of manufacturing the ink jet head 4 will be described. FIG. 8 is a flowchart for describing the method of manufacturing the ink jet head 4. FIGS. 9 to 20B are explanatory diagrams for describing the method of manufacturing the ink jet head 4. FIGS. 9 to 17 are cross sectional views. FIGS. 18A to 20B are perspective views. Note that, in FIGS. 11A to 14B, and FIGS. 18A to 20B, FIGS. 11A, 12A, 13A and 14A, and FIGS. 18A, 19A, and 20A illustrate the first head chip 40A side, and FIGS. 11B, 12B, 13B, and 14B, and FIGS. 18B, 19B, 20B illustrate the second head chip 40B side. Further, for convenience, in the cross sectional views illustrated in FIGS. 11A to 17, a cross section that passes through the through holes 84 and 91 in the base plates 41 and 81, and a cross section that passes through the ejection channel 51*a* in the actuator plates 42 and 82 are collectively illustrated.

As illustrated in FIG. 8, the method of manufacturing the ink jet head 4 in the present embodiment includes a first step (S1), a second step (S2), and a third step (S3).

(First Step)

In the first step (S1), preliminary arrangement before bonding is performed with respect to the base plates 41 and 81, the actuator plates 42 and 82, and the cover plates 43 and 83. Note that, in the first step (S1), respective steps of the base plates 41 and 81, the actuator plates 42 and 82, and the cover plates 43 and 83 can be performed in parallel. Further, in the description below, the same step at the first head chip 40A side and the second head chip 40B side will be collectively described.

First, as the preliminary arrangement of the base plates 41 and 81, the electrode forming regions are roughened on the one principal planes 41*a* and 81*a* of the respective base plates 41 and 81 (S11: a roughening step). To be specific, regions that are to become the first extracting electrodes 71 and 72, and the land portion 87 of the second individual extracting electrode 80 are roughened by a sandblast method or the like to have the surface roughness Ra with which the plated film 120 can be formed, on the one principal plane 41*a* of the first base plate 41. Similarly, the electrode forming regions (regions that are to become the extracting portions 85 and 92 of the second individual extracting electrodes 80 and 90) are caused to have the surface roughness Ra with which the plated film 120 can be formed, on the one principal plane 81*a* of the second base plate 81. Note that, in the roughening step (S11), the roughening method is not limited to the sandblast method, and the base plates 41 and 81 may be roughened using etching, a laser, or the like.

Figure 9:
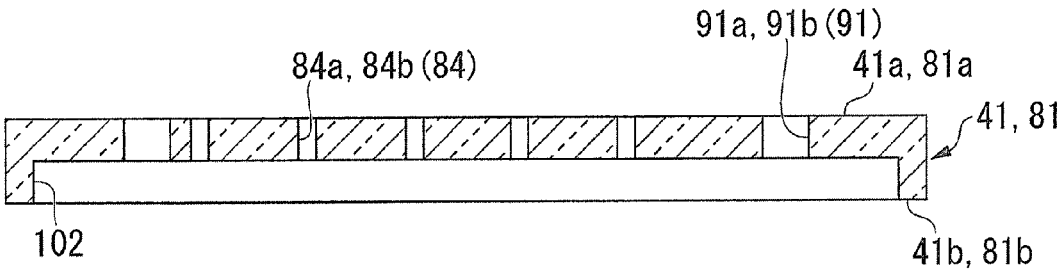
FIG. 9 is an explanatory diagram (cross sectional view) for describing the method of manufacturing the ink jet head.

Next, as illustrated in FIG. 9, the through holes 84 and 91 are formed in the base plates 41 and 81 using the sandblast method or the like (S12: a through hole forming step). To be specific, communication groove portions 102 extending along the Y direction are formed in the forming regions of the through holes 84*a* and 84*b*, and 91*a* and 91*b* from the other principal planes 41*b* and 81*b* side, of the base plates 41 and 81, and the through holes 84*a* and 84*b*, and 91*a* and 91*b* respectively communicating to the communication groove portions 102 are formed from the one principal planes 41*a* and 81*a* side. Note that, by performing the through hole forming step (S12) by the sandblast method, the inner surfaces of the through holes 84*a* and 84*b*, and 91*a* and 91*b*, and the vicinities of the through holes 84 and 91 on the other principal planes 41*b* and 81*b*, of the base plates 41 and 81, are roughened to have the surface roughness Ra with which the plated film 120 can be formed. Note that the through hole forming step (S12) may be performed by etching or drilling, instead of the sandblast method.

Figure 10:
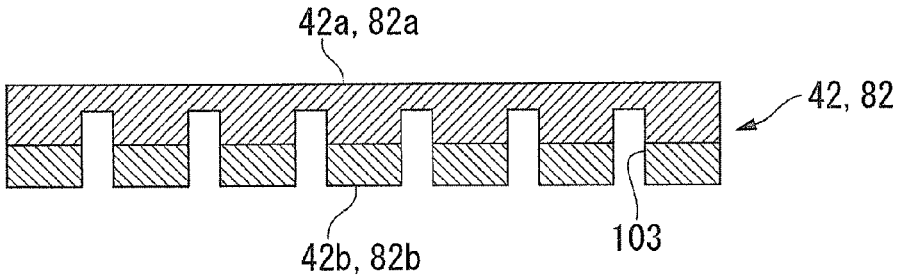
FIG. 10 is an explanatory diagram (cross sectional view) for describing the method of manufacturing the ink jet head.

Further, as illustrated in FIG. 10, as the preliminary arrangement of the actuator plates 42 and 82, recessed portions 103 that are to be the dummy channel 51*b* are formed in the other principal planes 42*b* and 82*b* side of the actuator plates 42 and 82 (S13: a recessed portion forming step). To be specific, the recessed portions 103 extending in a straight line manner are formed along the Z direction with a space in the Y direction by cutting using dicing or the like. Note that the recessed portions 103 are formed to be open at the both end surfaces of the actuator plates 42 and 82 in the Z direction. Further, the depth of the recessed portions 103 in the X direction corresponds to the height of the center block 53 and the outer side block 54 in the X direction.

Further, as illustrated in FIG. 8, as the preliminary arrangement of the cover plates 43 and 83, a film forming method such as deposition or plating is performed on the one principal planes 43*a* and 83*a* of the cover plates 43 and 83 through a mask (not illustrated), so that the connection wiring 65 (see FIG. 4) is formed (S14: a connection wiring forming step).

Following that, sandblast or the like is applied to the cover plates 43 and 83, so that the common ink chamber 63 and the slit 64 are formed in the cover plates 43 and 83 (S15: a common ink chamber forming step).

(Second Step)

Figure 11A:
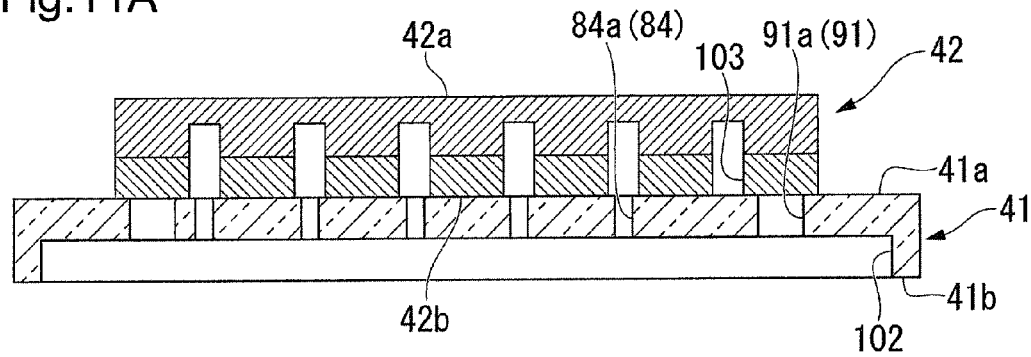
FIGS. 11A and 11B are explanatory diagrams (cross sectional views) for describing the method of manufacturing the ink jet head.
Figure 11B:
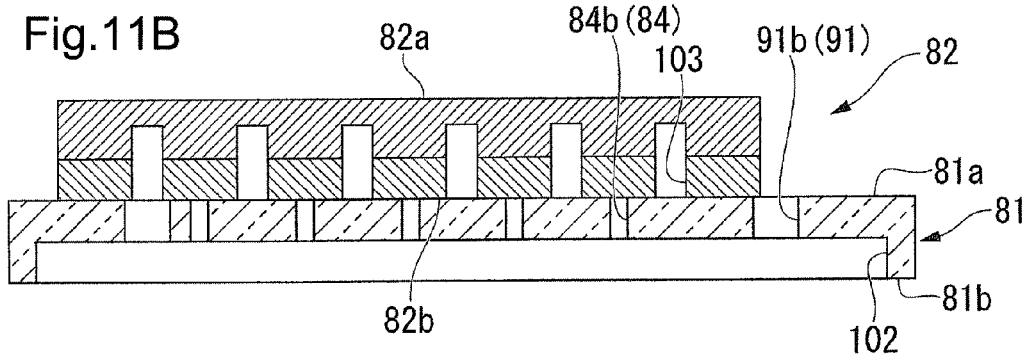
Figure 12A:
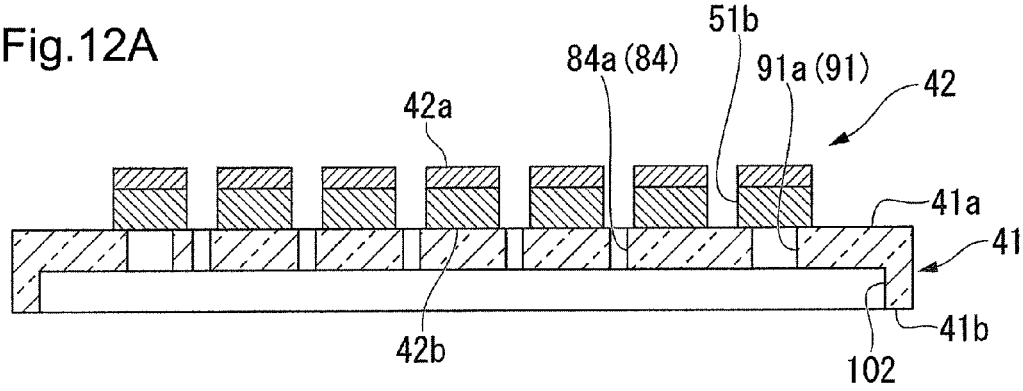
FIGS. 12A and 12B are explanatory diagram (cross sectional views) for describing the method of manufacturing the ink jet head.
Figure 12B:
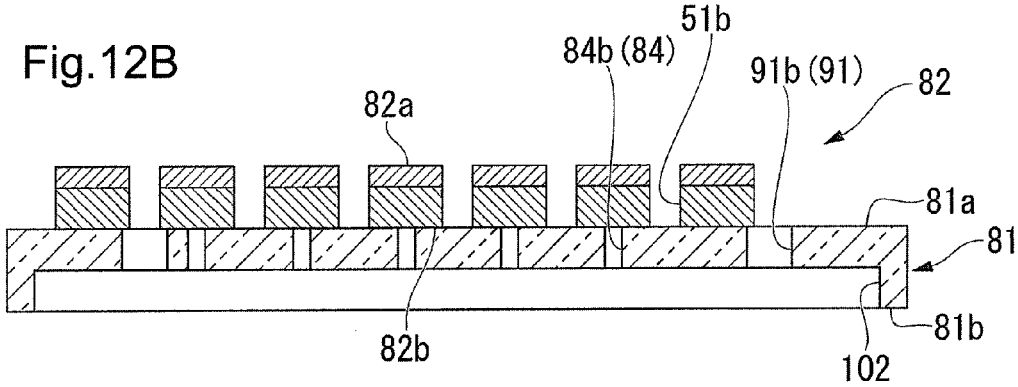
Figure 18A:
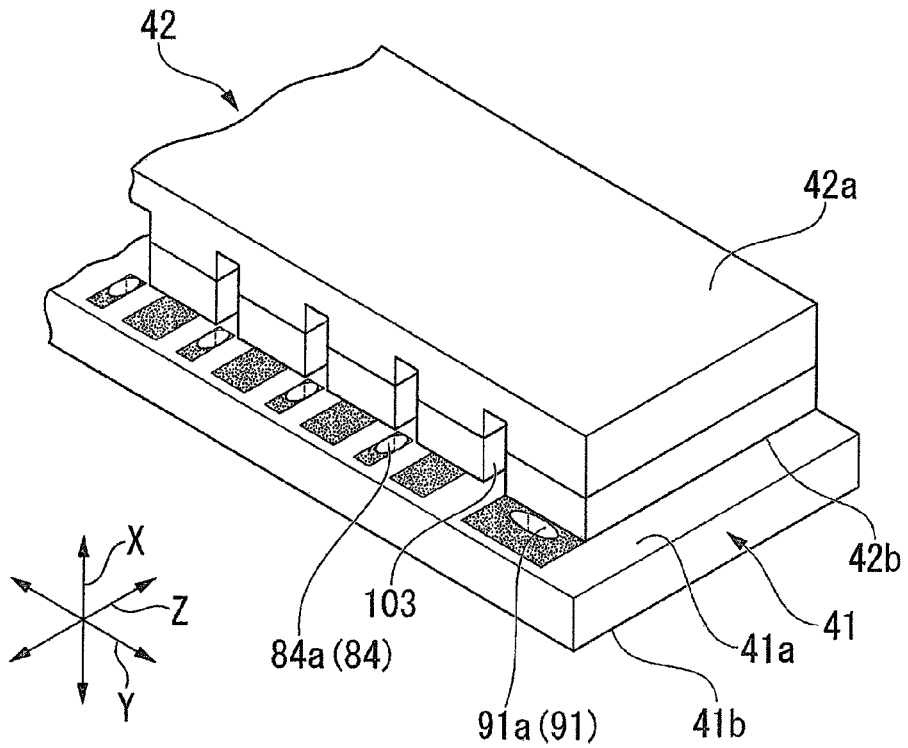
FIGS. 18A and 18B are explanatory diagrams (perspective views) for describing the method of manufacturing the ink jet head.
Figure 18B:
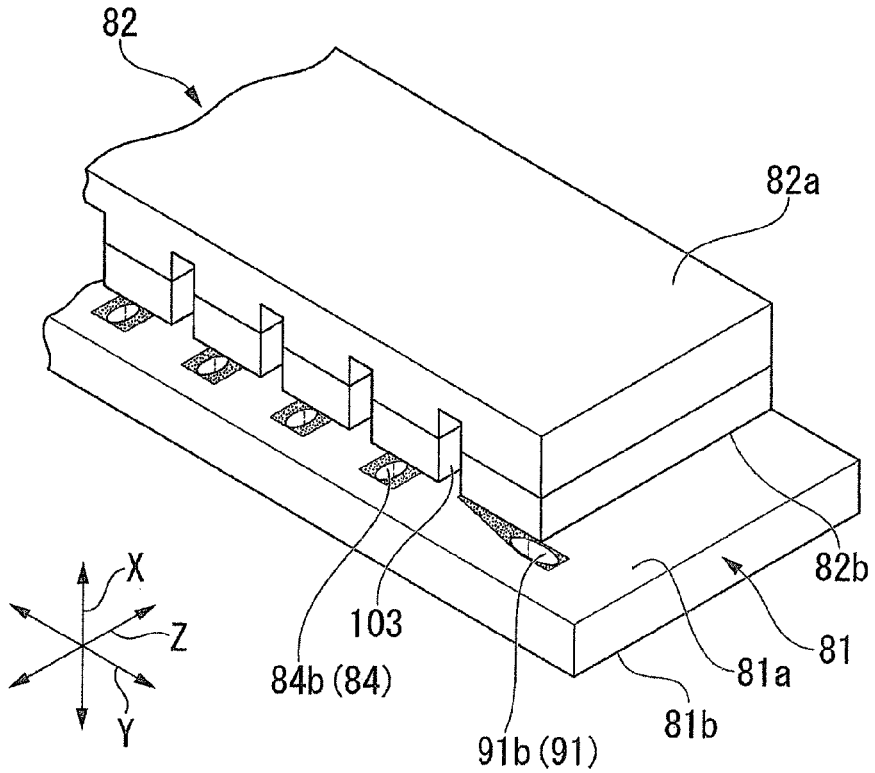
Figure 19A:
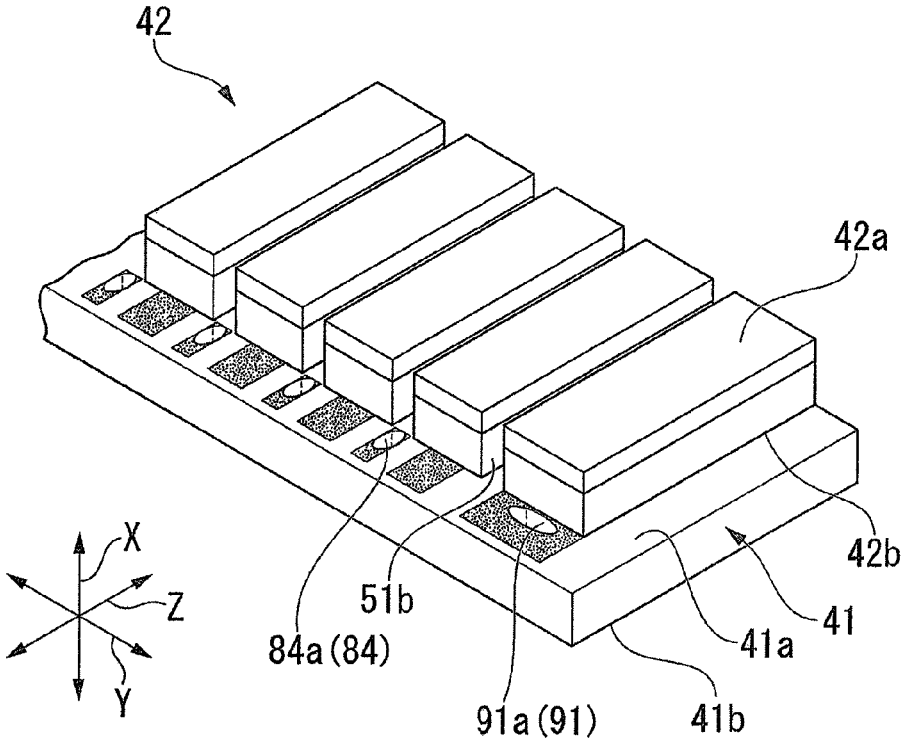
FIGS. 19A and 19B are explanatory diagrams (perspective views) for describing the method of manufacturing the ink jet head.
Figure 19B:
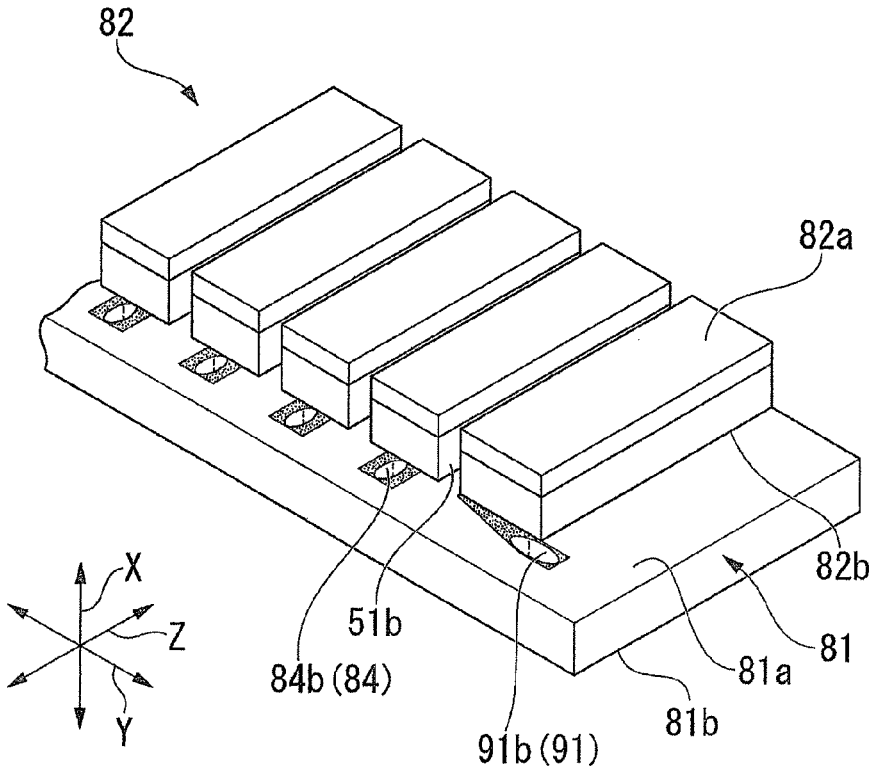

As illustrated in FIGS. 11A, 11B, 18A, and 18B, in the second step (S2), first, the base plates 41 and 81, and the actuator plates 42 and 82 are bonded each other (S21: an actuator plate bonding step). At this time, the both plates 41 and 42, and 81 and 82 are positioned such that rear end surfaces of the actuator plates 42 and 82, and front end edges of the forming regions of the drive electrodes 55 to 58 in the base plates 41 and 81 (dotted regions in FIGS. 18A and 18B) accord with each other in the Z direction, and then the both plates 41 and 42, and 81 and 82 adhere together using an adhesive or the like. Note that the positioning of the both plates 41 and 42, and 81 and 82 may just be performed such that the rear end surfaces of the actuator plates 42 and 82 and the front end edges of the forming regions of the drive electrodes 55 to 58 in the base plates 41 and 81 are not separated in the Z direction. That is, the positioning of the both plates 41 and 42, and 81 and 82 may just be performed such that the rear end surfaces of the actuator plates 42 and 82, and the front end edges of the forming regions of the drive electrodes 55 to 58 in the base plates 41 and 81 overlap in the Z direction. Further, at this time, as illustrated in FIGS. 11A and 18A, the first base plate 41 and the first actuator plate 42 are positioned to come to positions equal to the recessed portions 103 and the through holes 84*a* and 91*a* in the Y direction. Meanwhile, as illustrated in FIGS. 11B and 18B, the second base plate 81 and the second actuator plate 82 are positioned such that the through holes 84*b* and 91*b* are positioned between the recessed portions 103 in the Y direction.

Next, as illustrated in FIGS. 12A, 12B, 19A, and 19B, the one principal planes 42*a* and 82*a* of the actuator plates 42 and 82 are ground by a grinder or the like, and the recessed portions 103 are allowed to penetrate (S22: a grinding step).

Accordingly, the actuator plates 42 and 82 are separated to the center block 53 and the outer side block 54, and the dummy channels 51*b* are formed between the center blocks 53, and between the center block 53 and the outer side block 54. Note that, in the present embodiment, the principal planes positioned at the opposite side to the base plates 41 and 82, of the principal planes of the actuator plates 42 and 81, are the one principal planes 42*a* and 82*a* in any state.

Figure 13A:
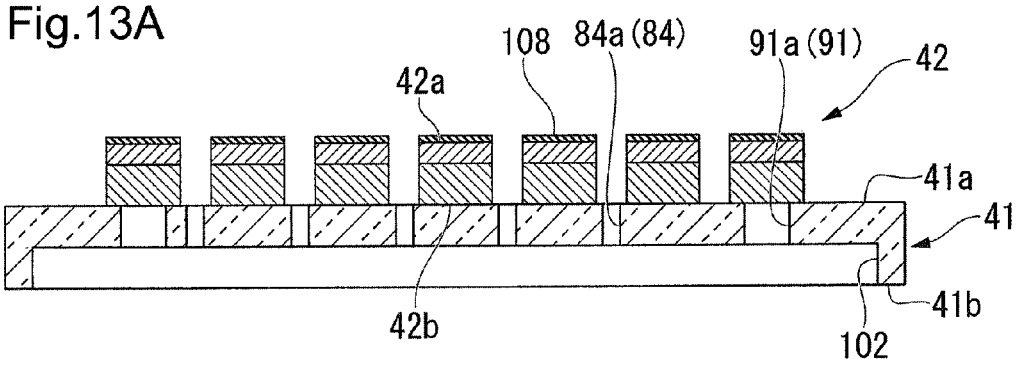
FIGS. 13A and 13B are explanatory diagrams (cross sectional views) for describing the method of manufacturing the ink jet head.
Figure 13B:
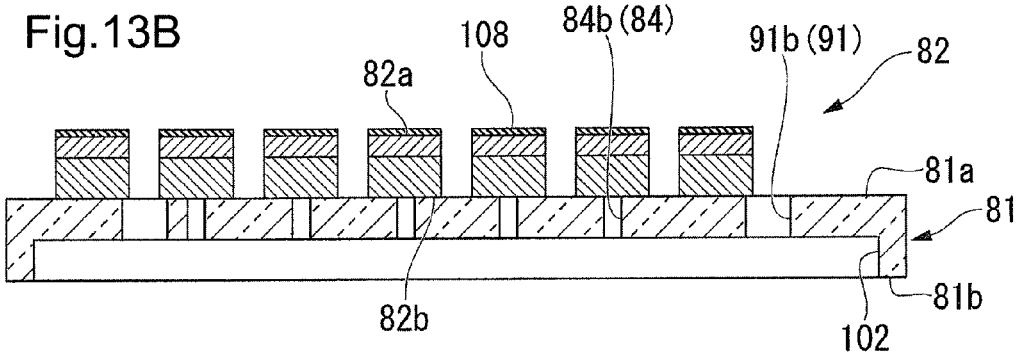

Following that, as illustrated in FIGS. 13A and 13B, masks 108 that cover regions other than the forming regions of the drive electrodes 55 to 58 and the ground terminal 61, of surfaces of the actuator plates 42 and 82 (the center block 53 and the outer side block 54), are formed (S23: a mask forming step). To specific, first, mask materials made of a photosensitive dry film or the like adhere on the one principal planes 42*a* and 82*a* of the actuator plates 42 and 82. Next, the mask materials are patterned using a photolithography technology, so that the mask materials on the portion corresponding to the forming regions of the terminals 56 to 58, of the mask materials, are removed.

Figure 14A:
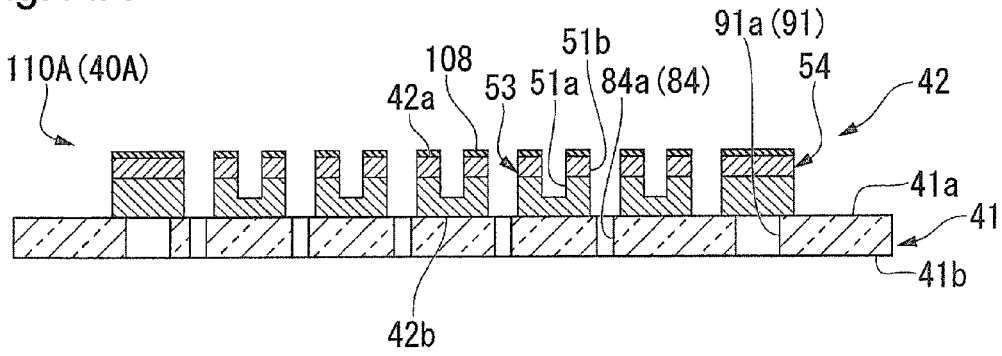
FIGS. 14A and 14B are explanatory diagrams (cross sectional views) for describing the method of manufacturing the ink jet head, and FIG. 14A illustrated the first head chip side
Figure 14B:
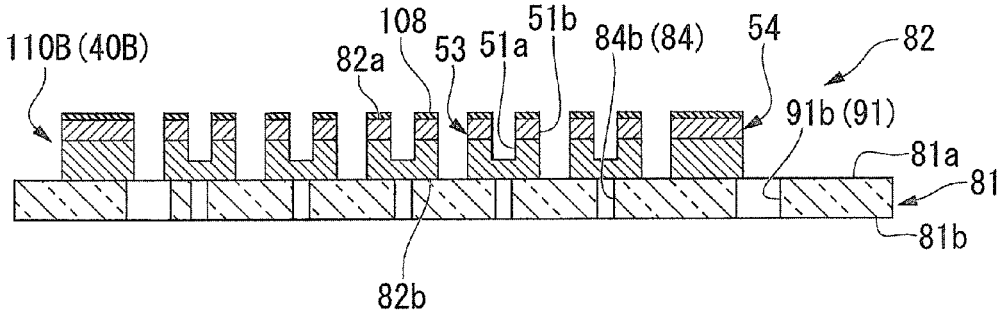

Next, as illustrated in FIGS. 14A and 14B, cutting such as dicing is performed with respect to the one principal plane 42*a* of the center block 53, and the ejection channel 51*a* is formed (S24: an ejection channel forming step). Note that, in the present embodiment, a method of performing the ejection channel forming step (S24) after the mask forming step (S23) has been described. However, the method is not limited thereto, and the mask forming step (S23) may be performed after the ejection channel forming step (S24). Note that it is favorable to perform the mask forming step (S23) first in that an alignment mark or the like used in the ejection channel forming step (S24) can be collectively performed to the masks 108.

Next, the entire other principal planes 41*b* and 81*b* in the base plates 41 and 81 are ground using a grinder or the like, and the communication groove portions 102 are removed (S25: a base plate grinding step). Accordingly, the through holes 84*a* and 84*b*, and 91*a* and 91*b* penetrating the entire base plates 41 and 81 in the X direction are formed. Note that the base plate grinding step (S25) can be performed at any timing as long as it is on or after the through hole forming step (S12). Note that it is favorable to perform the base plate grinding step (S25) immediately before an adhering step (S31) described below in terms of securing of strength of the base plates 41 and 81.

(Third Step)

Figure 15:
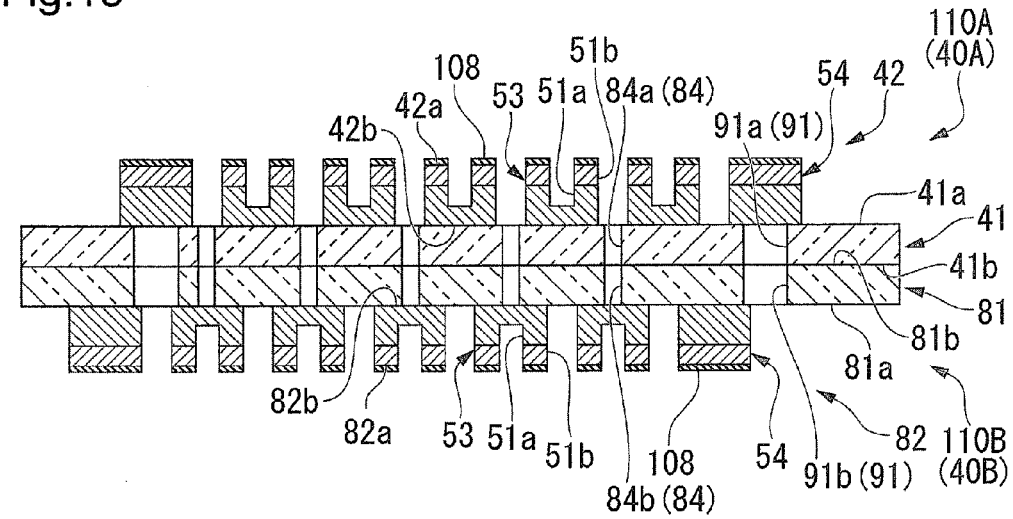
FIG. 15 is an explanatory diagram (cross sectional view) for describing the method of manufacturing the ink jet head.

As illustrated in FIG. 15, in the third step, first, the base plates 41 and 81 of the first boning body 110A of the first base plate 41 and the first actuator plate 42, and the second bonding body 110B of the second base plate 81 and the second actuator plate 82 adhere together (S31: an adhering step). To be specific, the base plates 41 and 81 adhere together such that the corresponding through holes 84*a* and 84*b*, and 91*a* and 91*b* communicate to each other between the base plates 41 and 81. Accordingly, between the bonding bodies 110A and 110B, the bonding bodies 110A and 110B adhere together in a state in which the ejection channels 51*a* are arranged in a zigzag manner.

Next, the drive electrodes 55 to 58, the ground terminal 61, and the extracting electrodes 71, 72, 80, and 90 are collectively formed to the bonding bodies 110A and 110B (S32: an electrode forming step). In the present embodiment, electrode forming step (S32) is performed by electroless plating.

In the electrode forming step (S32), first, a catalyst is provided to the electrode forming regions in which the drive electrodes 55 to 58, the ground terminal 61, and the extracting electrodes 71, 72, 80 and 90, of the bonding bodies 110A and 110B. To be specific, first, sensitizing processing is performed in which, the bonding bodies 110A and 110B are dipped in a tin(II) chloride aqueous solution, and tin(II) chloride is absorbed in surfaces of the bonding bodies 110A and 110B.

Following that, the bonding bodies 110A and 110B are roughly washed by water. Following that, the bonding bodies 110A and 110B are dipped in a palladium chloride aqueous solution, and palladium chloride is absorbed in the surfaces of the bonding bodies 110A and 110B. Then, an oxidation-reduction reaction is caused between palladium chloride absorbed in the surfaces of the bonding bodies 110A and 110B, and tin(II) chloride absorbed by the sensitizing processing, so that metal palladium is educed as a catalyst (activating processing).

Here, in the present embodiment, the catalyst is also provided to the electrode forming regions of the base plates 41 and 81 (on the one principal planes 41*a* and 81*a* and the inner surfaces of the through holes 84 and 91), in addition to the entire surfaces of the actuator plates 42 and 82, of the bonding bodies 110A and 110B, by the anchor effect. Meanwhile, the region (non-forming region) other than the electrode forming regions of the base plates 41 and 81 has small surface roughness Ra, and thus the catalyst is not provided.

Figure 16:
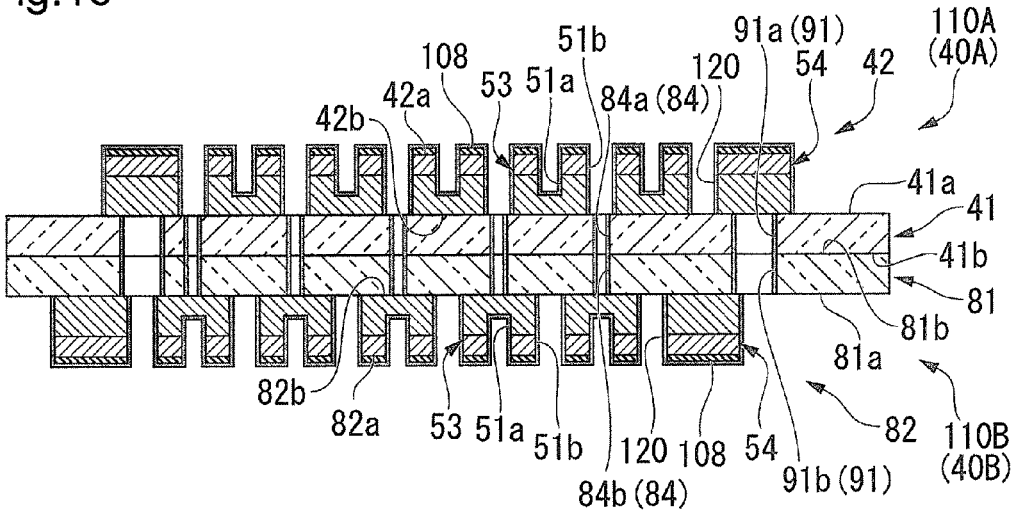
FIG. 16 is an explanatory diagram (cross sectional view) for describing the method of manufacturing the ink jet head.

Next, as illustrated in FIG. 16, the bonding bodies 110A and 110B are dipped in a plating solution in which the catalyst (metal palladium) is provided, so that the plated film 120 is educed on the portion to which the catalyst is provided, of the bonding bodies 110A and 110B. Note that, in the present embodiment, the non-forming region includes the portion positioned between the center blocks 53, on the one principal planes 41*a* and 81*a* of the base plates 41 and 81. Therefore, the catalyst is not provided to the portion that configures the bottom surface of the dummy channel 51*b* of the base plates 41 and 81. Therefore, when forming the individual electrodes 57 by plating, it can be set that the plated film 120 can be educed only on the side wall surfaces (the facing surfaces of the center block 53), of the inner surface of the dummy channel 51*b*, and the plated film 120 is not educed on the bottom surface. Accordingly, it is not necessary to remove the plated film 120 educed on the bottom surface of the dummy channel 51*b* by a laser or the like, for example. Therefore, the manufacturing cost can be reduced, and refuse generated in post steps can be reduced. In addition, the short circuit of the individual electrodes 57, which are formed on the side wall surfaces of the dummy channel 51*b*, through the bottom surface, can be reliably prevented.

Figure 17:
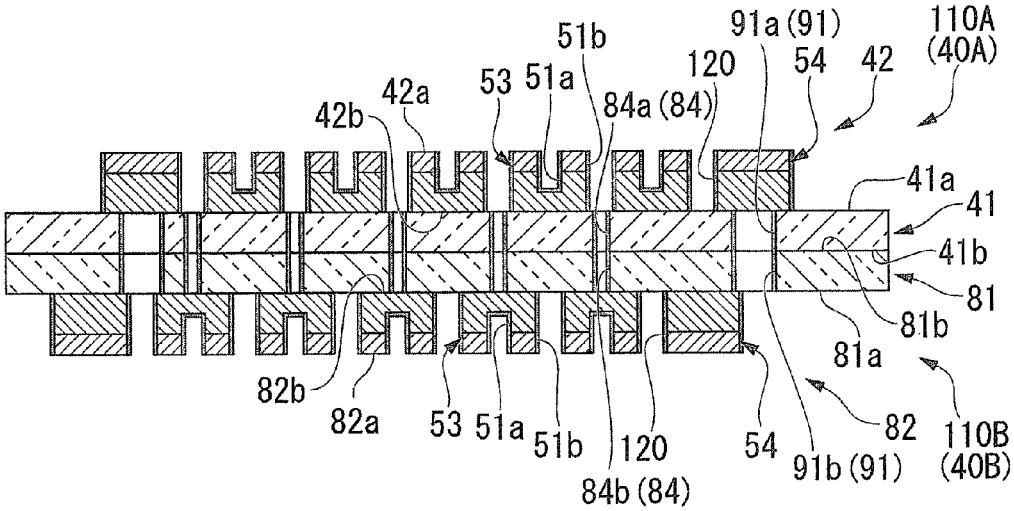
FIG. 17 is an explanatory diagram (cross sectional view) for describing the method of manufacturing the ink jet head.
Figure 20A:
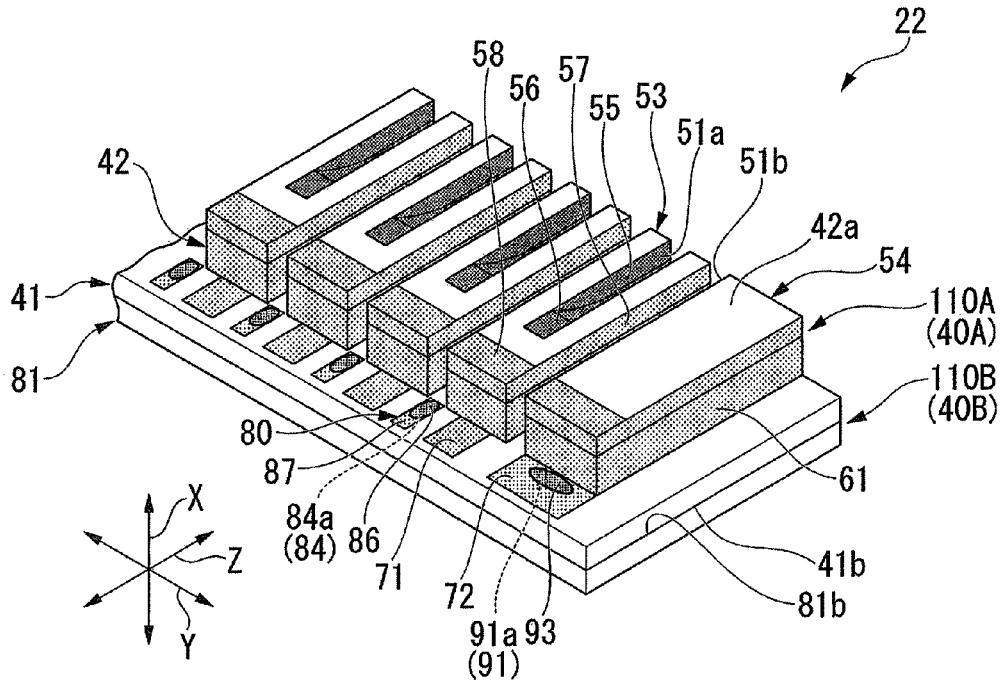
FIGS. 20A and 20B are explanatory diagrams (perspective views) for describing the method of manufacturing the ink jet head.
Figure 20B:
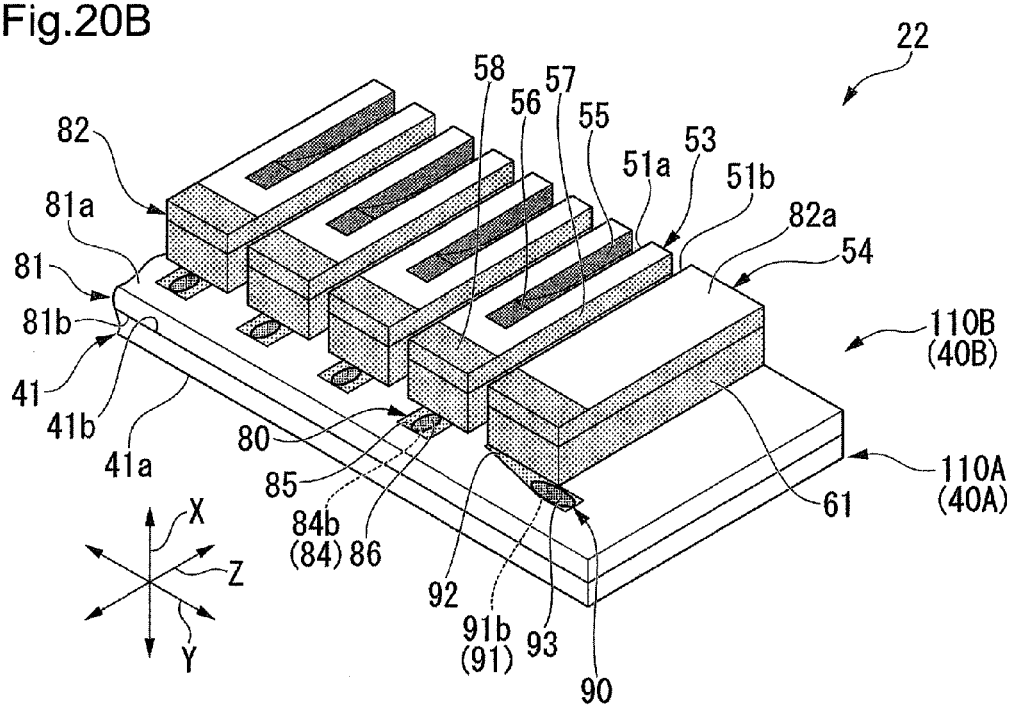

Following that, as illustrated in FIGS. 17, 20A, and 20B, the masks 108 formed on the one principal planes 42*a* and 82*a* of the actuator plates 42 and 82 are removed (S33: a lifting off step). Accordingly, the drive electrodes 55 to 58, the ground terminal 61, and the extracting electrodes 71, 72, 80, and 90 are collectively formed on the bonding bodies 110A and 110B.

Then, as illustrated in FIGS. 4 and 5, the groove portions 62 are formed on the one principal planes 42*a* and 82*a* of the actuator plates 42 and 82 (S34: a groove forming step). To be specific, the groove portions 62 extending along the Y direction to divide the common terminal 56 and the individual terminal 58 are formed on the one principal planes 42*a* and 82*a* of the actuator plates 42 and 82 by cutting such as dicing. Note that, in the above-described embodiment, an example of forming the groove portions 62 in the entire actuator plates 42 and 82 in the Y direction (the center block 53 and the outer side block 54) has been described. However, the groove portions 62 may just be formed at least only in the center block 53.

Next, the cover plates 43 and 83 are bonded on the one principal planes 42*a* and 82*a* of the actuator plates 42 and 82 (S35: a cover plate bonding step). To be specific, both of the plates 42 and 43, and 82 and 83 are positioned such that the ejection channels 51*a* of the actuator plates 42 and 82, and the slits 64 of the cover plates 43 and 83 communicate to each other. Further, in the present embodiment, both of the plates 42 and 43, and 82 and 83 are positioned such that the main wiring 68 overlaps with the groove portions 62 in the X direction, and the common connection portion 66 and the ground connection portion 67 are separately connected to the corresponding common terminal 56 and the ground terminal 61, of the connection wiring 65. Then, after the positioning, the plates 42 and 43, and 82 and 83 are bonded by an adhesive or the like.

Note that, in the present embodiment, as described above, the external shapes of the cover plates 43 and 83 in planar view as viewed from the X direction accord with the external shapes of the entire actuator plates 42 and 82 in planar view as viewed from the X direction. Therefore, only the end surfaces of the plates 42 and 43, and 82 and 83 are positioned to flush with each other, whereby the positioning of various portions can be automatically completed.

Following that, the nozzle plate 44 is bonded on the front end surfaces of the head chips 40A and 40B (S36: a nozzle plate bonding step).

Finally, the flexible print substrate 33 is connected on the one principal plane 41*a* of the first base plate 41. Accordingly, the wiring pattern of the flexible print substrate 33 is electrically connected to the first extracting electrodes 71 and 72, and the land portion 87 of the second individual extracting electrode 80 formed on the one principal plane 41*a* of the base plate 41.

Then, the ejecting portion 22 configured as described above is mounted on the carriage 16, so that the ink jet head 4 of the present embodiment is completed.

As described above, the present embodiment employs the configuration in which the base plates 41 and 81 of the first head chips 40A and the second head chip 40B adhere together, and the second extracting electrodes 80 and 90 of the second head chip 40B are pulled out on the first base plate 41 through the through holes 84 and 91.

According to the configuration, the flexible print substrate 33 is merely connected on the one principal plane 41*a* of the first base plate 41, electrical conduction between the head chips 40A and 40B, and the flexible print substrate 33 can be secured. Therefore, the configuration of the present invention can realize high density recording with the reduction of the number of parts and the simplification of the configuration, compared with the conventional configuration in which separated flexible print substrates 33 are connected to the head chips 40A and 40B.

Further, the through holes 84 and 91 are arrayed at an equal pitch between the base plates 41 and 81, whereby the through holes 84 and 91 can be used as a reference for positioning when the base plates 41 and 81 adhere together. As a result, the through holes 84 and 91 of the base plates 41 and 81 can reliably communicate to each other, with the simplification of the configuration, and the second extracting electrodes 80 and 90 can be reliably pulled out on the one principal plane 41*a* of the first base plate 41.

Further, the base plates 41 and 81 are made of a glass material. Therefore, the surface roughness Ra of the non-forming region can be made small. In this case, formation of the plated film 120 on the non-forming region can be suppressed. Therefore, the patterning step after the formation of the plated film 120 becomes unnecessary, whereby efficiency of the manufacturing process steps can be enhanced, and the reduction in cost can be achieved.

Further, the printer 1 of the present embodiment includes the ink jet head 4. Therefore, the printer 1 can support the high density recording, and the printer 1 having excellent reliability can be provided.

Note that the technical range of the present invention is not limited to the above-described embodiment, and various modifications can be added without departing from the gist of the present invention.

For example, in the above-described embodiment, the ink jet printer 1 has been described as an example of a liquid jet apparatus. However, the liquid jet apparatus is not limited to the printer. For example, the liquid jet apparatus may be a facsimile machine, an on-demand printer, or the like.

Further, in the above-described embodiment, the printer 1 for a plurality of colors on which a plurality of ink jet heads 4 is mounted has been described. However, the printer 1 is not limited to the example. For example, a printer 1 for single color, which has one ink jet head 4, can be employed.

Further, as the ink used in the embodiment of the present invention, various materials can be used, such as an aqueous ink, a solvent ink, a UV ink, a fine metal particle ink, a carbon ink (carbon black, carbon nanotube, fullerene, or graphene). Note that, among the inks, the aqueous ink, the solvent ink, and the UV inks are favorably used for the printer 1 for a plurality of colors, and the fine metal particle ink and the carbon ink are favorably used for the printer 1 for single color.

Further, in the above-described embodiment, a case of configuring the base plates 41 and 81 by glass has been described. However, the configuration is not limited thereto. Design change of the materials of the base plates 41 and 81 can be appropriately performed as long as the materials can suppress the surface roughness Ra of the non-forming region to a degree (for example, about 100 Å) with which the plated film 120 cannot be formed, such as a ceramic material.

Further, in the above-described embodiment, a case of configuring the two-array type ejecting portion 22 by bonding the base plates 41 and 81 on which the actuator plates 42 and 82 are bonded are bonded together. However, the ejecting portion 22 is not limited to the example. For example, an ejecting portion in which actuator plates are respectively arranged on both sides of one base plate in the thickness direction may be employed.

Figure 21:
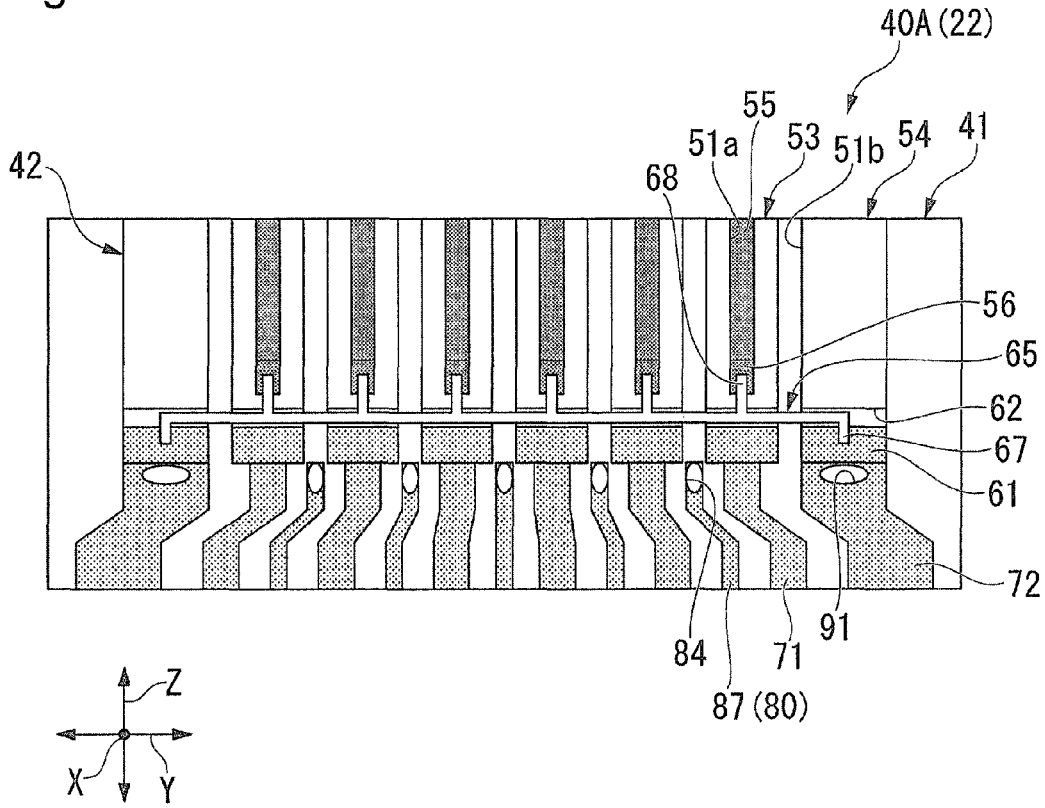
FIG. 21 is a plan view of an ejecting portion illustrating another configuration as viewed from a first head chip side.

Further, in the above-described embodiment, a case of linearly forming the first extracting electrodes 71 and 72, and the land portion 87 of the second extracting electrode 80 along the Z direction has been described. However, the configuration is not limited thereto. For example, as illustrated in FIG. 21, the first extracting electrodes 71 and 72, and the land portion 87 of the second extracting electrode 80 may be formed to extend outward of the Y direction as going to the rear side. In this case, the specific shapes of the first extracting electrodes 71 and 72, and the land portion 87 of the second extracting electrode 80 may be a fan shape, or may be a trapezoid. That is, any shape is included in the shapes as long as the shape has a folding-fan shape where the width in the Y direction becomes wider as going to the Z direction.

According to the configuration, the spaces between the first extracting electrodes 71 and 72, and the land portion 87 of the second extracting electrode 80 become wider as going to the rear side. Therefore, the short circuit between the first extracting electrodes 71 and 72, and the land portion 87 of the second extracting electrode 80 can be suppressed, and the electrical reliability can be secured. In addition, complexity of the electrode patterns can be suppressed.

Note that the land portion 87 of the extracting electrode 80 extends outward in the Y direction as going to the rear side, whereby the widths of the first extracting electrodes 71 and 72, and the land portion 87 of the second extracting electrode 80 can be increased.

Further, in the above-described embodiment, an example of forming the individual through hole 84 between the adjacent first extracting electrodes 71 has been described. However, the configuration is not limited thereto. The first extracting electrode 71 and the individual through hole 84 may be shifted and arranged in the Z direction.

Further, between the base plates 41 and 81, at least parts of the corresponding individual through holes 84*a* and 84*b*, and of the ground through holes 91*a* and 91*b* may just communicate to each other. That is, in the present embodiment, in the through hole forming step (S12), the other principal planes 41*b* and 81*b* are roughened by grinding, so that the plated film 120 can be formed. Therefore, if at least parts of the corresponding individual through holes 84*a* and 84*b*, and of the ground through holes 91*a* and 91*b* communicate to each other, the through portions 86 and 93 are formed through the plated films 120 formed on the other principal planes 41*b* and 81*b* of the base plates 41 and 81.

Further, in the above-described embodiment, in the through hole forming step (S12), a configuration of roughening the inner surfaces of the through holes 84*a* and 84*b*, and 91*a* and 91*b* at the same time as the formation of the through holes 84*a* and 84*b*, and 91*a* and 91*b*, by using the sandblast method, has been described. However, the configuration is not limited thereto. That is, the formation of the through holes 84*a* and 84*b*, and 91*a* and 91*b* (a perforating step), and the roughening of the inner surfaces of the through holes 84*a* and 84*b*, and 91*a* and 91*b* (a roughening step) may be separately performed.

In addition, the configuration elements in the above-described embodiment can be appropriately replaced with known configuration elements without departing from the gist of the present invention, and the above-described modifications may be appropriately combined.

What is claimed is:

1. A liquid jet head comprising:

a base plate;

a first actuator portion and a second actuator portion separately arranged on a first principal plane and a second principal plane of the base plate, and configured to jet a liquid;

a first drive electrode and a second drive electrode separately formed on the first actuator portion and the second actuator portion, and configured to respectively drive the first actuator portion and the second actuator portion;

a first extracting electrode electrically connected to the first drive electrode on the first principal plane of the base plate; and a second extracting electrode electrically connected to the second drive electrode on the second principal plane of the base plate, wherein the second extracting electrode is pulled out on the first principal plane through a through hole formed in the base plate.

2. The liquid jet head according to claim 1, wherein the base plate includes a first plate to which the first actuator portion is fixed, and a second plate to which the second actuator portion is fixed, and bonded to the first plate, and the through hole includes a plurality of first through holes formed in the first plate, and a plurality of second through holes formed in the second plate, arrayed with an equal pitch to the first through holes, and separately communicating to the first through holes.

3. The liquid jet head according to claim 1, wherein a space between the first extracting electrode and the second extracting electrode becomes wider as being separated from the first actuator portion, on the first principal plane.

4. The liquid jet head according to claim 1, wherein the first actuator portion and the second actuator portion separately include a plurality of channel blocks arranged in parallel with a space, a jet channel in which the liquid is filled is formed in the channel block, and a portion defined by the adjacent channel blocks and the base plate configures a dummy channel in which the liquid is not filled, the first drive electrode and the second drive electrode avoid a portion defined by the base plate, of an inner surface of the dummy channel, and separately include individual electrodes formed on facing surfaces of the adjacent channel blocks, and the base plate includes an electrode forming region in which the first extracting electrode and the second extracting electrode are formed, and a non-forming region that includes at least the portion that defines the dummy channel, and has smaller surface roughness than the electrode forming region.

5. The liquid jet head according to claim 1, wherein the base plate is made of a glass material.

6. A liquid jet apparatus comprising:

a liquid jet head according to claim 1; and a moving mechanism configured to relatively move the liquid jet head and a recording medium.

* * * * *